US011702771B2

(12) United States Patent
Porte et al.

(10) Patent No.: US 11,702,771 B2
(45) Date of Patent: Jul. 18, 2023

(54) SHEDDING MECHANISM AND JACQUARD-TYPE WEAVING LOOM EQUIPPED WITH SUCH A MECHANISM

(71) Applicant: STAUBLI LYON, Chassieu (FR)

(72) Inventors: Alexis Porte, Tignieu-Jameyzieu (FR); Pascal Guenard, Chaponnay (FR)

(73) Assignee: STAUBLI LYON, Chassieu (FR)

( * ) Notice: Subject to any disclaimer, the term of this patent is extended or adjusted under 35 U.S.C. 154(b) by 21 days.

(21) Appl. No.: 17/551,583

(22) Filed: Dec. 15, 2021

(65) Prior Publication Data

US 2022/0195641 A1 Jun. 23, 2022

(30) Foreign Application Priority Data

Dec. 21, 2020 (FR) ..... 2013853

(51) Int. Cl.

| | |
|---|---|
| ***D03C 3/20*** | (2006.01) |
| ***D03C 3/02*** | (2006.01) |
| ***D03C 13/00*** | (2006.01) |
| *D03C 9/00* | (2006.01) |

(52) U.S. Cl.

CPC ..... *D03C 3/02* (2013.01); *D03C 13/00* (2013.01)

(58) Field of Classification Search

CPC . D03C 3/02; D03C 13/00; D03C 3/20; D03C 5/00; D03C 3/26; D03C 3/12

See application file for complete search history.

(56) References Cited

U.S. PATENT DOCUMENTS 3,529,635 A * 9/1970 Heinz ..... D03C 3/20 139/59
3,944,134 A * 3/1976 Frappe ..... D03C 17/00 234/85
5,133,389 A * 7/1992 Griffith ..... D03C 3/20 139/65

(Continued)

FOREIGN PATENT DOCUMENTS

EP 0823501 A1 2/1998
EP 0851048 A1 7/1998

(Continued)

OTHER PUBLICATIONS

French Search Report for France Application No. 2013853, dated May 20, 2021.

*Primary Examiner* — Robert H Muromoto, Jr.

(57) ABSTRACT

This shedding mechanism includes a housing and a movable hook which can be retained by a selection device including at least one electromagnet (100) immobilized in the housing and which includes a ferromagnetic core (102) comprising first and second pole faces (S122, S124). The electromagnet (100) also includes a non-magnetic portion (104, 108) and a retaining lever configured to retain the movable hook. The retaining lever is pivotally mounted about an oscillation axis (A144) and includes a ferromagnetic armature (202) that interacts magnetically with the first and second pole faces. The non-magnetic portion of the electromagnet includes a surface (S144) for guiding the pivoting of the retaining lever. This guide surface cooperates with the retaining lever in a direction radial to the oscillation axis (A144) between a remote position and a contact position. The guide surface (S144) is cylindrical with a circular base, centered on the oscillation axis.

16 Claims, 21 Drawing Sheets

(56) References Cited

U.S. PATENT DOCUMENTS

| | | | | |
|---|---|---|---|---|
| 5,176,186 | A * | 1/1993 | Bousfield | D03C 3/20 139/65 |
| 5,275,211 | A * | 1/1994 | Roth | D03C 3/20 139/455 |
| 5,309,952 | A * | 5/1994 | Speich | D03C 3/20 139/455 |
| 7,017,618 | B2 * | 3/2006 | Bassi | D03C 3/24 139/59 |
| 7,490,633 | B2 * | 2/2009 | Bouchet | D03C 3/12 139/65 |
| 2004/0079433 | A1 * | 4/2004 | Bassi | D03C 3/24 139/55.1 |

FOREIGN PATENT DOCUMENTS

| | | | |
|---|---|---|---|
| EP | 0899367 | A1 | 3/1999 |
| EP | 1413657 | A1 | 4/2004 |
| EP | 1619279 | A1 | 1/2006 |
| EP | 1852531 | A1 | 11/2007 |
| EP | 1619279 | B1 | 2/2008 |

* cited by examiner

SHEDDING MECHANISM AND JACQUARD-TYPE WEAVING LOOM EQUIPPED WITH SUCH A MECHANISM

The present invention relates to a shedding mechanism in a Jacquard-type weaving loom, and to a Jacquard-type weaving loom equipped with such a mechanism.

In a Jacquard-type weaving loom, a shedding mechanism selectively lifts healds each comprising an eyelet through which a warp thread passes. Depending on the position of a hook to which the upper end of each heald is connected, the yarn passing through its eyelet is located above or below a weft yarn moved by the loom. In practice, a shedding mechanism comprises a plurality of movable hooks each provided with a side nose adapted to cooperate with a vertically reciprocating knife. Each movable hook is able to interact with a retaining member that belongs to a selection device that is part of the shedding mechanism, this retaining member being controlled by means of an electromagnet.

As shown in the figures of EP-A-1413657, the electromagnet may be mounted in a housing that defines a pivot shaft for each retaining lever. The relative position of the retaining lever and the electromagnet, in particular of an attracting surface of the retaining lever to a pole face of the electromagnet, is therefore dependent on the positioning of the electromagnet in the housing. Depending on the manufacturing and positioning tolerances, this relative position can therefore vary, within the shedding mechanism, for the different selection devices. This position can also vary over time. Thus, the value of an air gap or air gaps formed between the retaining lever and the ferromagnetic core of the electromagnet is dependent on variations in the positioning of the electromagnet in the housing, which can greatly influence the magnetic force exerted between the lever and the electromagnet, when the electromagnet is activated.

Comparable structures are known from EP-A-0823501, EP-A-0851048, EP-A-0899367, EP-A-1619279 and EP-A-1852531, which are generally satisfactory but induce similar problems in terms of variations in the relative positioning of the retaining levers and the electromagnet.

The present invention aims to improve the accuracy and reliability of the selection obtained by means of a shedding mechanism, in which the relative position of the retaining lever and the electromagnet is accurately and reliably determined, thereby enabling the magnetic attraction force between these elements and the supply current to the electromagnet to be precisely controlled.

To this end, the invention relates to a shedding mechanism on a Jacquard-type weaving loom, this mechanism comprising a housing which extends according to a longitudinal direction, at least one movable hook, moved in the housing by a knife according to the longitudinal direction, between a bottom dead center position and a top dead center position, in or near which the hook can be retained by a selection device which comprises at least one electromagnet, which is attached and immobilized in the housing and which includes a ferromagnetic core comprising a first pole face and a second pole face, these pole faces being offset from each other according to the longitudinal direction, and a non-magnetic part integral with the ferromagnetic core. The selection device also comprises a retaining lever configured to retain the movable hook when the hook is in or near its top dead center position. The retaining lever is pivotally mounted about an oscillation axis between a position remote from the electromagnet and a position in contact with the electromagnet and comprises a ferromagnetic armature that interacts magnetically with the first and second pole faces to control the angular position of the retaining lever about the oscillation axis. According to the invention, the non-magnetic portion of the electromagnet comprises a guide surface for guiding the pivoting of the retaining lever about the oscillation axis, this guide surface cooperating with the retaining lever in a direction radial to the oscillation axis between the remote position and the contact position. The guide surface is cylindrical with a circular base, centered on the oscillation axis.

By the invention, the fact that the guide surface of the retaining lever is formed on the electromagnet, and not on the housing, ensures precise and constant positioning of the retaining lever relative to the pole faces of the electromagnet, thus an equally precise and constant air gap. The magnetic force required to keep the retaining lever in a position in contact with the electromagnet is therefore the same for all the selection devices of the shedding mechanism, which is advantageous in terms of controlling the weaving method on the loom.

According to advantageous but non-mandatory aspects of the invention, such a shedding mechanism may incorporate one or more of the following features, taken in any technically permissible combination

- The guide surface is the outer peripheral surface of a guide shaft about which the retaining lever is pivotally mounted.
- The non-magnetic part of the electromagnet also comprises a flange from which the guide surface extends, and in that a volume for receiving a portion of the retaining lever is delimited according to a direction radial to the oscillation axis by the guide surface and according to a direction parallel to the oscillation axis by the flange.
- The flange is arranged in a ring around one end of the guide shaft.
- The housing is formed by a half-shell for receiving the selection device and a cover, the half-shell and the cover being stacked according to a second direction of the housing which is perpendicular to the longitudinal direction, while the oscillation axis extends according to the second direction of the housing, while the half-shell or the cover forms a recessed housing with a shape complementary to the guide shaft, and an annular surface is formed around the recessed housing, in that a free end of the guide shaft, opposite the flange, is engaged in the recessed housing and rests against a bottom of this hollow housing, in the second direction of the housing, and in that a part of the retaining lever is arranged between the flange and the annular surface in the second direction of the housing.
- The first pole face is a portion of a cylinder centered on the oscillation axis, while a part of the armature of the retaining lever is interposed between the guide surface and the first pole face radially to the oscillation axis and that the cooperation between the guide surface and the retaining lever ensures the absence of contact between the first pole face and the armature between the contact position and the remote position of the retaining lever.
- The first pole face extends on either side of a transverse plane passing through the oscillation axis and perpendicular to the longitudinal direction and in that the ratio between, on the one hand, the angular amplitude of a portion of the first pole face situated, relative to the transverse plane, on the same side as the second pole face and, on the other hand, the total angular amplitude of the first pole face, is between 0.2 and 0.4, preferably equal to 0.33.

The armature of the retaining lever comprises an outer attracting surface which faces the second pole face when the retaining lever is in a position in which it is in contact with the electromagnet, while the retaining lever comprises a non-magnetic body which is integral with the armature, and which comprises at least one abutment surface which is adjacent to the outer attracting surface.

protruding, in the direction of the electromagnet, relative to the outer attracting surface.

remote from the electromagnet when the retaining lever is in its position remote from the electromagnet; and in contact with the electromagnet when the retaining lever is in its position in contact with the electromagnet, while, in the position of the retaining lever in contact with the electromagnet, the outer attracting surface is remote from the second pole face.

The non-magnetic portion of the electromagnet comprises a frame that comprises the guiding surface and is made of polymeric material overmolded onto the ferromagnetic core.

The electromagnet is fixed in the housing by fitting a centering pin into a centering recess according to a direction of the housing perpendicular to its longitudinal direction.

The non-magnetic portion of the electromagnet comprises a frame that comprises the guide surface, the frame being formed prior to assembly with the ferromagnetic core, while a quantity of polymeric material extends around the core and frame to secure the electromagnet in the housing.

The selection device comprises at least two retaining levers which are arranged at the same longitudinal level in the housing, on either side of the electromagnet according to a direction perpendicular to the longitudinal direction, and which each interact with one of two lower and one of two upper pole faces of the ferromagnetic core, while the guide surfaces which each cooperate with a retaining lever are formed on parts of the electromagnet which are integral with one another.

The flange is engaged in a recess, provided on the housing and delimited by a surface complementary to a radial outer surface of the flange, while the complementary surface is arranged opposite the flange according to the longitudinal direction and below the flange in the operating configuration of the mechanism.

A winding of the electromagnet is wound around an intermediate portion of the ferromagnetic core, located longitudinally between the first and second pole faces, and is in contact with at least one side face of the ferromagnetic core.

A surface of a first longitudinal end of the retaining lever cooperates with the guide surface for pivoting the lever between the remote position and the contact position, while in the operating configuration of the mechanism, the retaining lever extends generally from the first longitudinal end downwards, according to the longitudinal direction.

According to another aspect, the invention relates to a Jacquard-type weaving loom which comprises a shedding mechanism as mentioned above.

This loom presents the same advantages as the shedding mechanism.

The invention will be better understood and other advantages thereof will become clearer in the light of the following description of several embodiments of a shedding mechanism and a loom in accordance with the principle thereof, given by way of example only and made with reference to the appended drawings, wherein.

Figure 1:
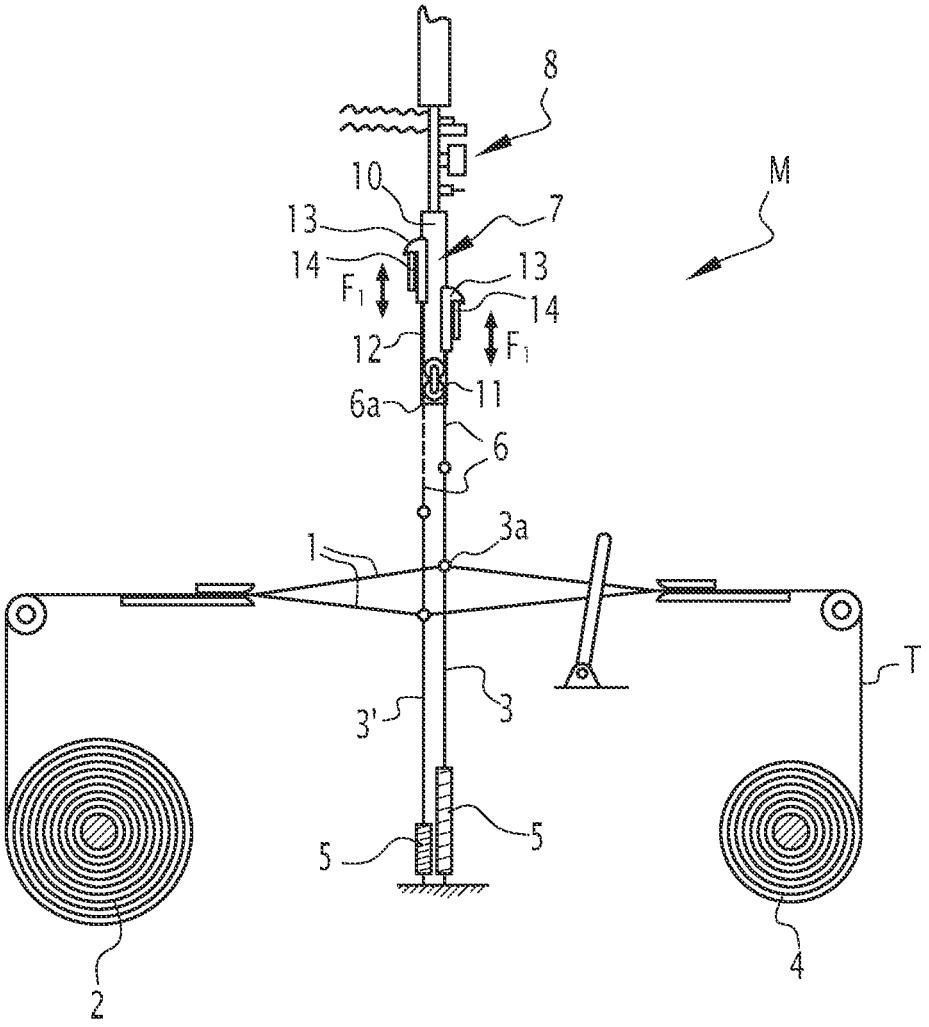
FIG. 1 is a schematic representation of principle showing a Jacquard-type weaving loom consistent with the invention and incorporating a shedding mechanism consistent with the invention.

In the Jacquard-type weaving loom M shown in FIG. 1, a warp yarn sheet 1 comes from a warp beam 2. Each warp thread 1 passes through the eye 3*a* of a heald 3 designed to open the shed to allow the passage of a weft in order to form a fabric T that is wound onto a bobbin 4. Only two healds 3 and 3' are shown in FIG. 1, the heald 3 being in the upper position, while heald 3' is in the lower position. The lower end of each heald is connected to the fixed frame of the loom M by a tension spring 5, while its upper end is integral with a yoke 6.

A shedding mechanism 7, related to an electronic control unit 8 which controls it, allows to lift more or less each yoke 6 against a return force exerted by a spring 5.

As shown only for the yoke 6 related to the heald 3, each yoke has an end 6*a* integral with a housing 10 of the shedding mechanism 7, this yoke passing through a muffle 11 suspended from a cord 12 whose two ends are respectively integral with two mobile hooks 13 intended to be selectively lifted by knives 14 animated by a movement of alternating vertical oscillations in opposition of phase, as shown by the arrows F1 in FIG. 1. Other configurations of the yokes, cords and muffles are possible.

Only a portion of the constituent elements of the shedding mechanism 7 are represented in FIG. 1, for clarity of the drawing.

The shedding mechanism 7 can also be referred to as a "Jacquard module" and comprises a stack of several unitary housings, for example eight housings. A selection device, comprising an electromagnet and two retaining levers, is arranged in each unit housing. In addition, two hooks 13 are movable in each unit housing longitudinally, i.e., according to the longest dimension of the housing 10, which is vertical in the installed configuration of this housing within the shedding mechanism 7 mounted in the loom M. These two movable hooks are preferably integral with a single cord, such as the cord 12 shown in FIG. 1 from which the muffle 11 in which the yoke 6 passes is suspended.

Figure 2:
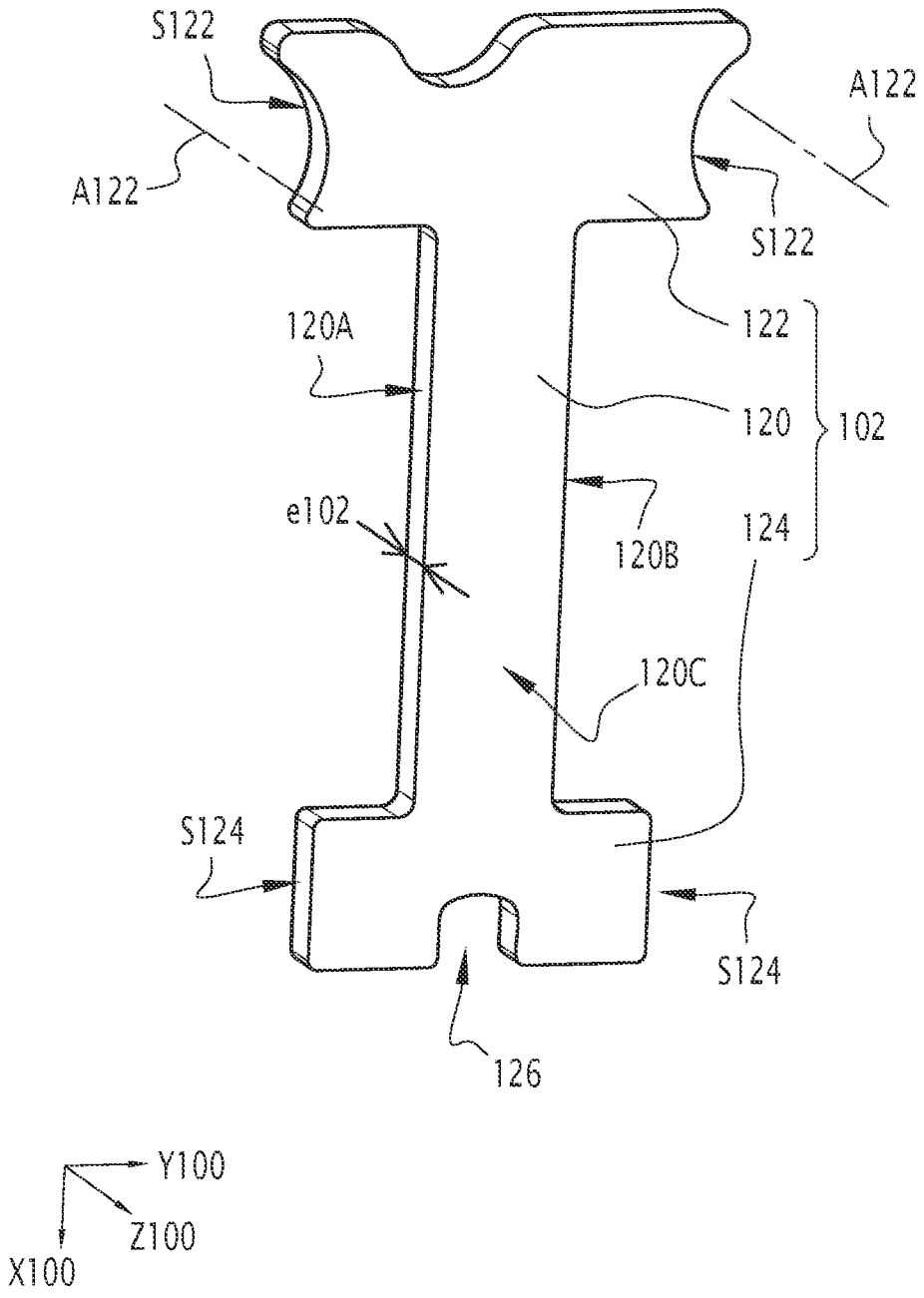
FIG. 2 is a perspective view of an electromagnet core belonging to the shedding mechanism of the loom of FIG. 1.

Each electromagnet 100 of the shedding mechanism 7 comprises a ferromagnetic core 102, shown alone in FIG. 2, a frame 104 made of non-magnetic material, a winding 106 wound around an intermediate portion of the core 102, a casing 108 and electrical contacts 110 intended to be connected to two electrical cables not shown which connect it to the electronic control unit 8 and which allow the selective power supply of this electromagnet 100. The frame 104 and the casing 108 together form a non-magnetic portion of the electromagnet 100. The winding 106 and the electrical contacts 110 also belong to the non-magnetic portion of the electromagnet 100. By "non-magnetic" is meant with a very low magnetic susceptibility, such that a non-magnetic part cannot interact magnetically with a ferromagnetic part.

Figure 4:
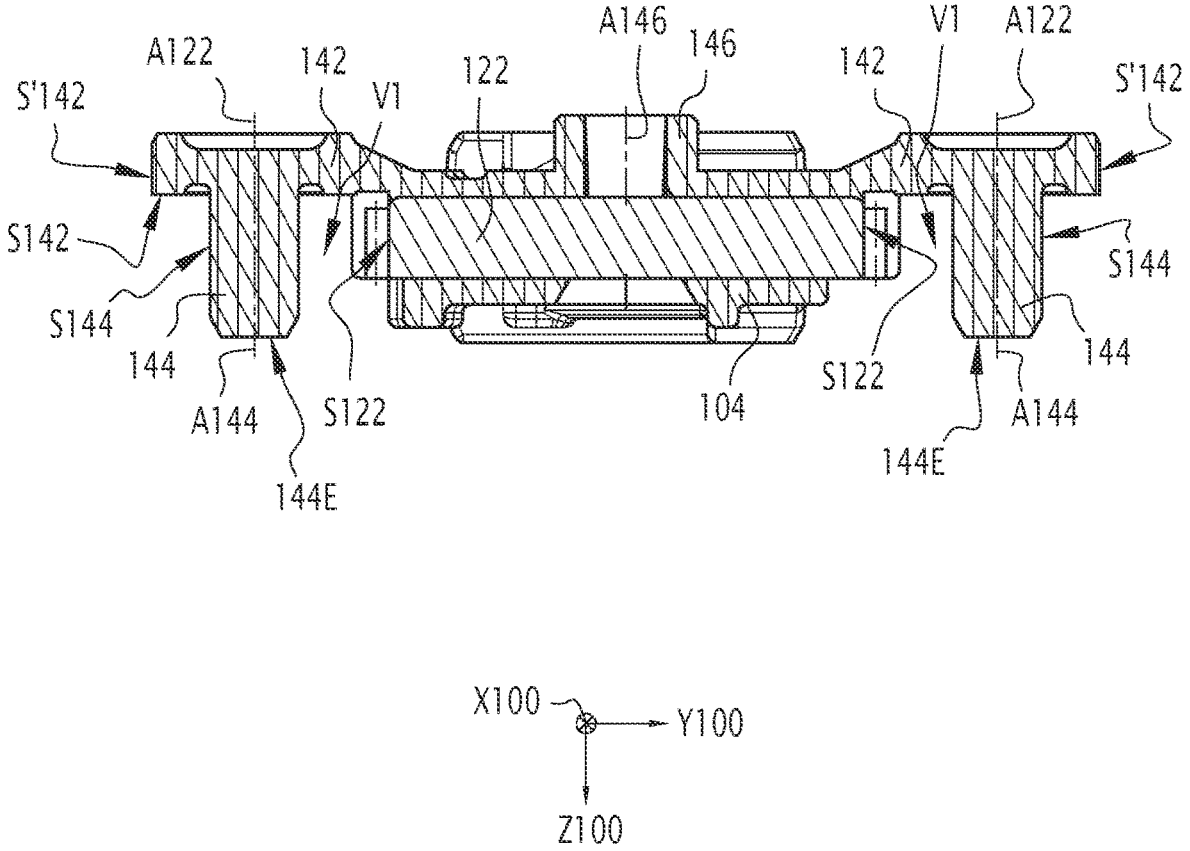
FIG. 4 is a larger scale cross-section according to the plane IV of FIG. 3.
Figure 5:
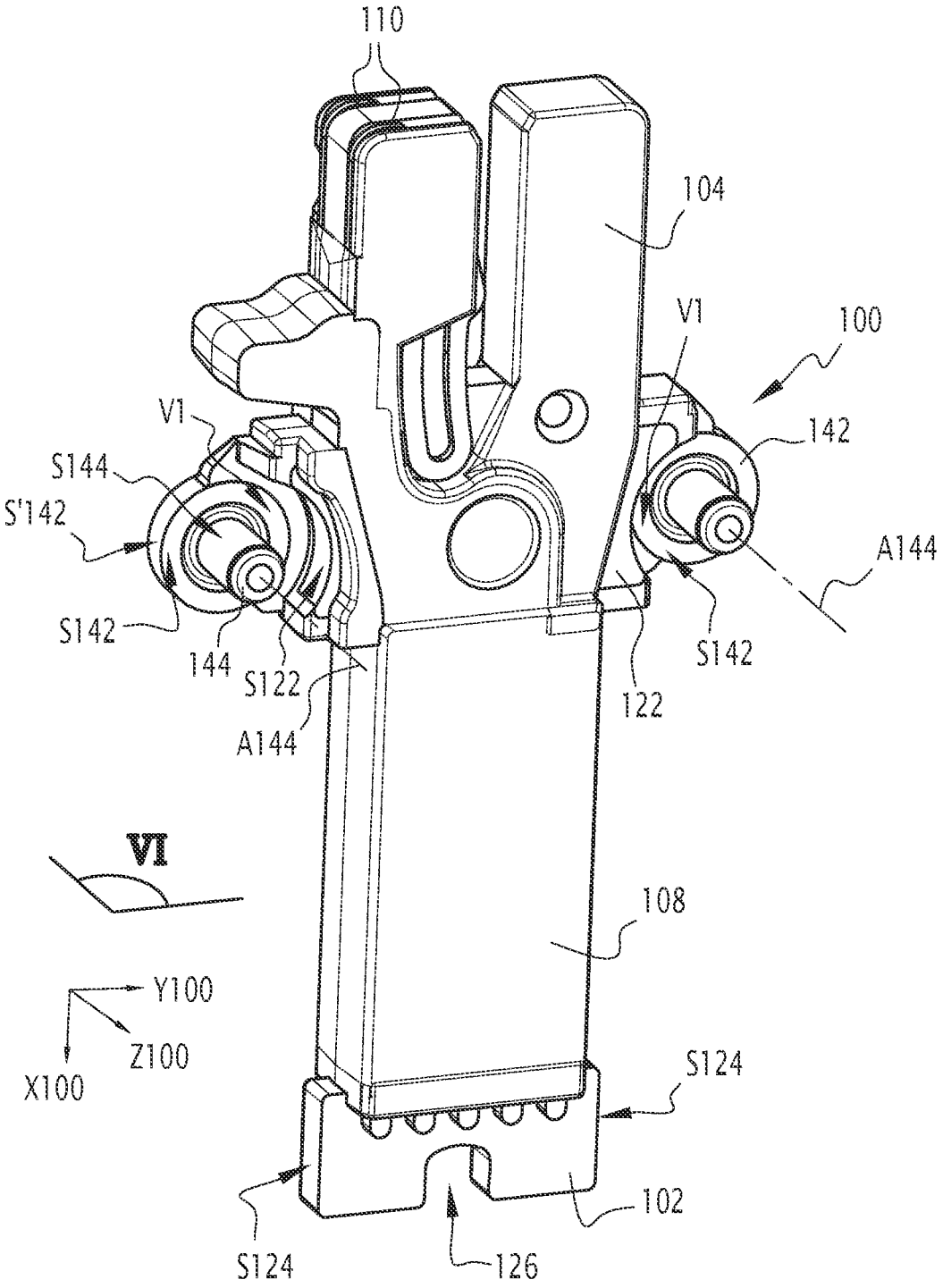
FIG. 5 is a perspective view of the electromagnet after fitting a protective overmold on the frame visible in FIG. 3.
Figure 6:
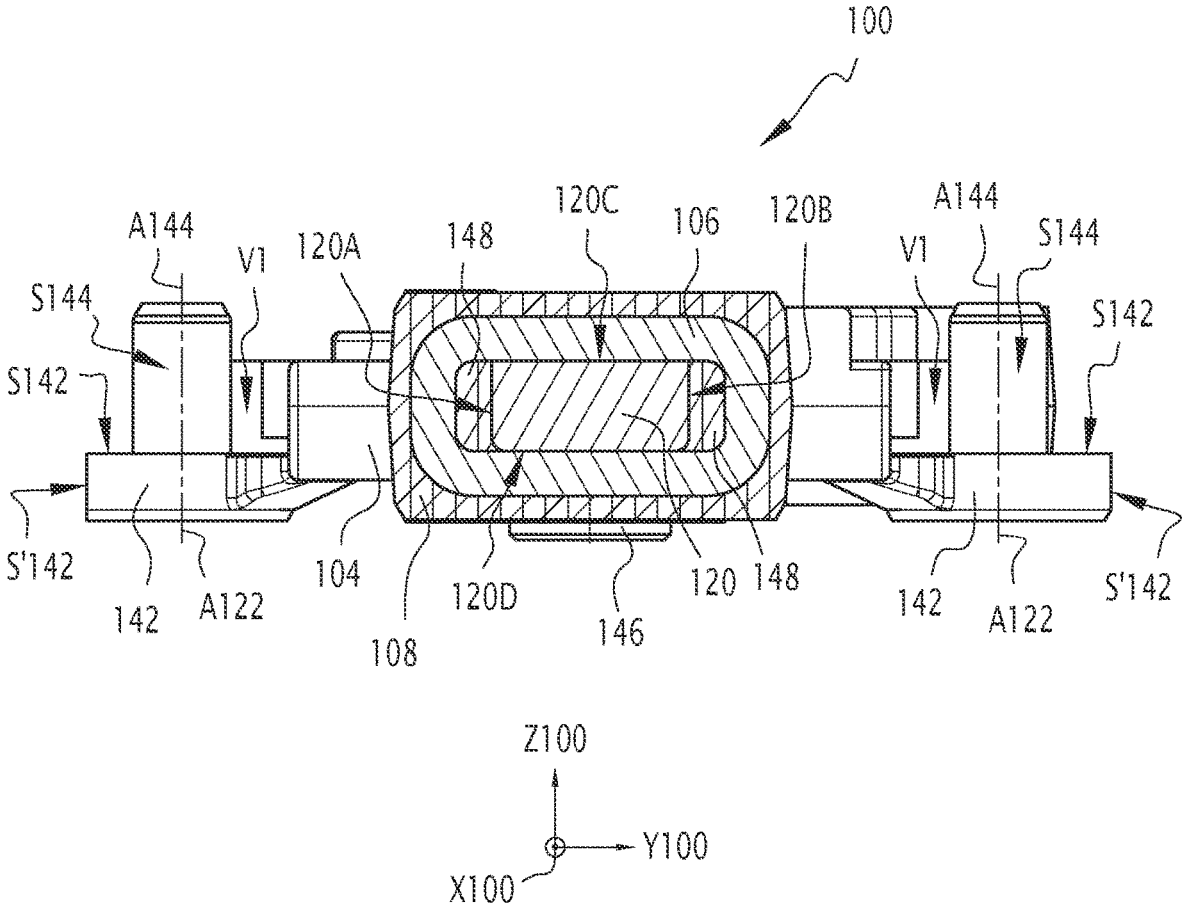
FIG. 6 is a larger scale cross-section in plane VI of FIG. 5.

A longitudinal axis of the electromagnet 100 oriented from top to bottom in FIG. 2 is noted as X100. A transverse axis of the electromagnet 100 oriented from left to right in FIG. 4 is noted as Y100. An axis of thickness or depth of the electromagnet 100 is noted as Z100, which is also the axis of the smallest dimension of the electromagnet 100. The axes X100, Y100, and Z100 together form a directly oriented orthogonal reference frame. FIGS. 4 and 6 are cross-sections taken in the direction of the axis X100 in FIG. 3 and in the opposite direction to the axis X100 in FIG. 5, respectively.

The core 102 presents a thickness e102, measured parallel to the axis Z100, that is constant. Core 102 is generally I shaped, with a longitudinal and central stem 120, which extends according to a direction parallel to the axis X100, and two transverse branches 122 and 124, which extend primarily in directions parallel to axis Y100. The longitudinal and central stem 120 is an intermediate portion between the transverse branches 122 and 124.

The lateral ends of the upper transverse branch 122 form two upper pole faces S122 of the electromagnet 100, these first pole faces being defined on the edge of the core 102, being concave, and being in the form of a section of a cylinder with a circular cross-section centered on an axis A122 perpendicular to the major plane surfaces of the core 102. The axes A122 are parallel to the axis Z100. On the other hand, the lateral ends of the lower transverse branch 124 form two lower pole faces S124 of the electromagnet 100. These second pole faces S124 are formed in the edge of the core 102, flat and parallel to the axes X100 and Z100.

The first pole faces S122 are offset from the second pole faces S124 along the axis X100.

A centering notch 126 is provided in the middle portion of the lower branch 124, on an edge of this lower branch opposite the central stem 120. The centering notch is located between and equidistant from the lower pole faces S124 along the axis Y100.

The frame 104 is overmolded around the core 102, which it partially surrounds. By "overmolded", we mean that the material of the frame 104 is injected into a mold in which the core 102 has been previously placed, so that the material of the frame 104 surrounds this core 102 and is attached to this core after curing. The frame 104 is made of a non-magnetic material, for example of the thermoplastic polymer type, possibly reinforced with fibers. Thus, the frame 104 is integral with the core 102 and has a fixed position relative to the core 102.

Figure 3:
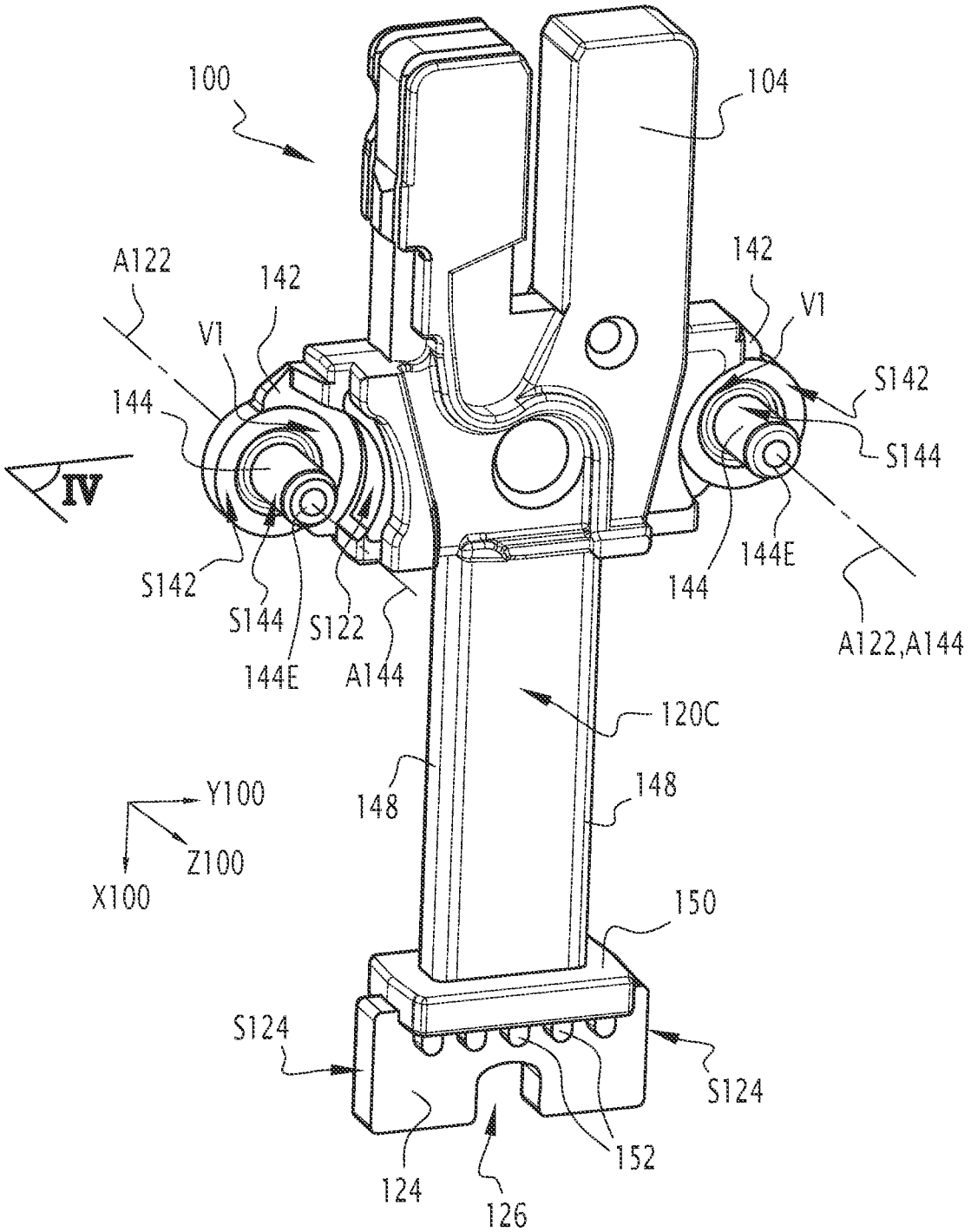
FIG. 3 is a perspective view of the electromagnet, after fitting an insulating frame on the core of FIG. 2.

As shown in FIG. 3, the frame surrounds the upper transverse branch 122 of the core 102, being flush with the surfaces S122. The frame 104 extends, on either side of the upper transverse branch 122, by a flange 142 and by a guide shaft 144 centered on a respective axis A144. The two flanges 142 and the two shafts 144 are part of the frame 104 which are integral with the rest of the frame 104, in particular with the portion of this frame that is located around the upper transverse branch 122. In other words, each guide shaft 144 is connected to the frame 104 and in particular to the adjacent flange 142 in a non-removable manner. The axes A144 are parallel to the axis Z100. Each axis A144 is coincident with the central axis A122 of the adjacent upper pole face S122. Thus, each axis A144 is at the same longitudinal level as the adjacent upper pole face S122. Each guide shaft 144 has a cylindrical outer shape with a circular cross-section, and its outer peripheral surface is noted as S144.

The frame 104 also defines a centering pin 146 that extends opposite a middle portion of the upper branch 122 and is centered on an axis A146 parallel to the axes A144 and the axis Z100. The centering pin 146 is also cylindrical with a circular cross section. Unlike the guide shafts 144, it is hollow, whereas the guide shafts are solid.

The frame 104 comprises two strips 148 that cover the edges 120A and 120B of the central stem 120, which are perpendicular to the axis Y100, but not the lateral faces 120C and 120D of this central stem, which are perpendicular to the axis Z100.

The frame 104 also comprises a foot 150, which covers the junction area between the stem 120 and the branch 124, and the slats 152.

The lower transverse branch 124 protrudes from the frame 104 both according to a longitudinal direction of the ferromagnetic core 102, parallel to the axis X100, and according to a transverse direction of this core, parallel to the axis Y100. In particular, the frame 104 does not extend at the level of the lower pole faces S124.

A flange 142 is located adjacent to one end of each guide shaft 144 and extends in a ring around it, while connecting that shaft to the remainder of the frame 104. The flanges 142 are formed on the non-magnetic portion of the electromagnet 100. A surface of each flange 142 that is annular, perpendicular to the axis Z100 and facing the side of the guide shaft 144 that this flange surrounds is noted as S142. This surface S142 is perpendicular to the axis A144 of the adjacent guide shaft 144 and extends in a ring, i.e., over 360°, around this guide shaft. The surfaces S142 and S144 are adjacent and perpendicular.

The peripheral surface of a flange 142 is noted as S'142. This surface is a portion of a cylinder with a circular base centered on the axis A144 of the adjacent guide shaft 144. Thus, the peripheral surface S'142 of a flange 142 is coaxial with the outer peripheral surface S144 of the adjacent guide shaft 144.

Figure 7:
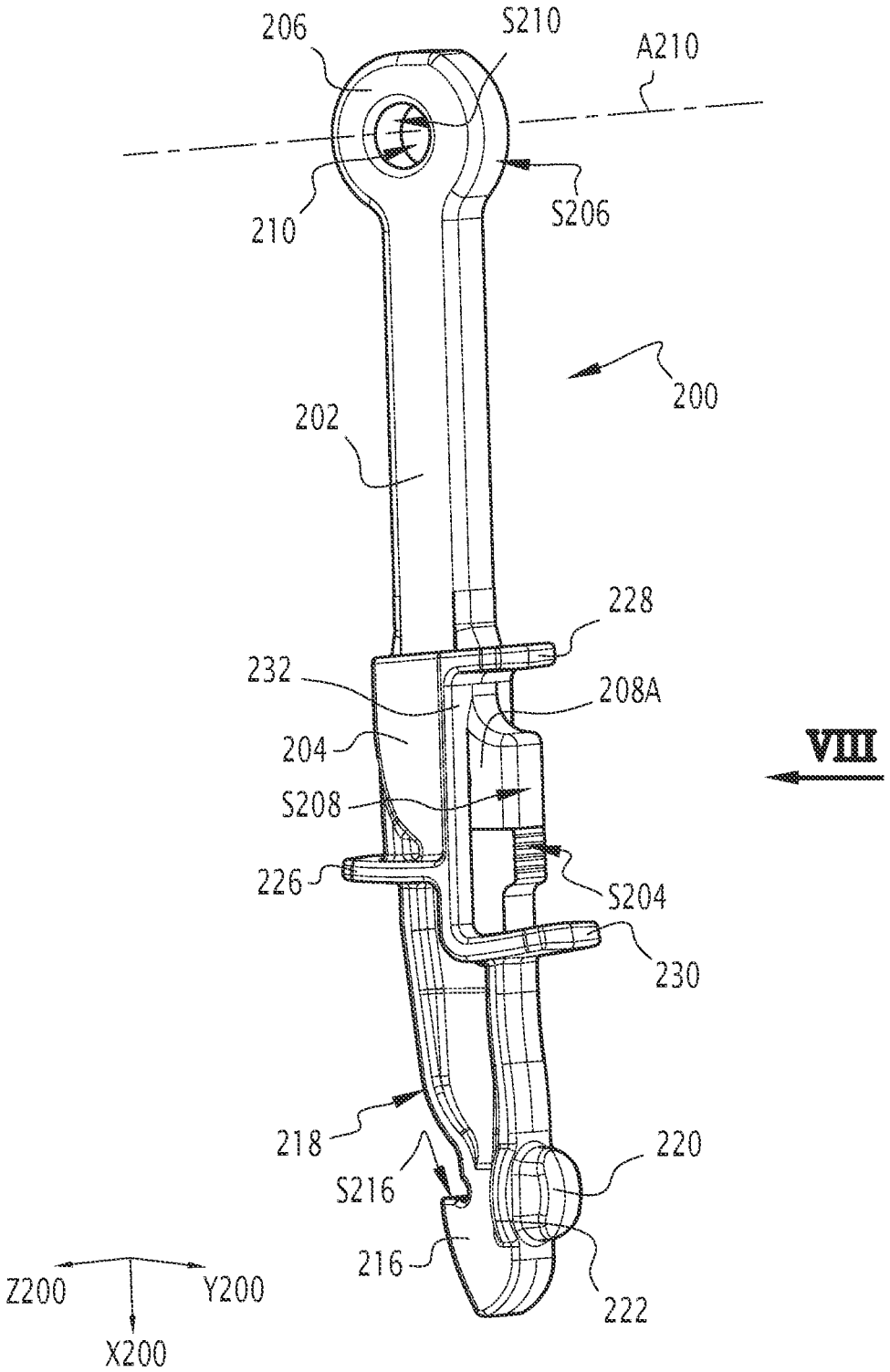
FIG. 7 is a perspective view of a retaining lever belonging to the shedding mechanism of the weaving loom of FIG. 1.
Figure 8:
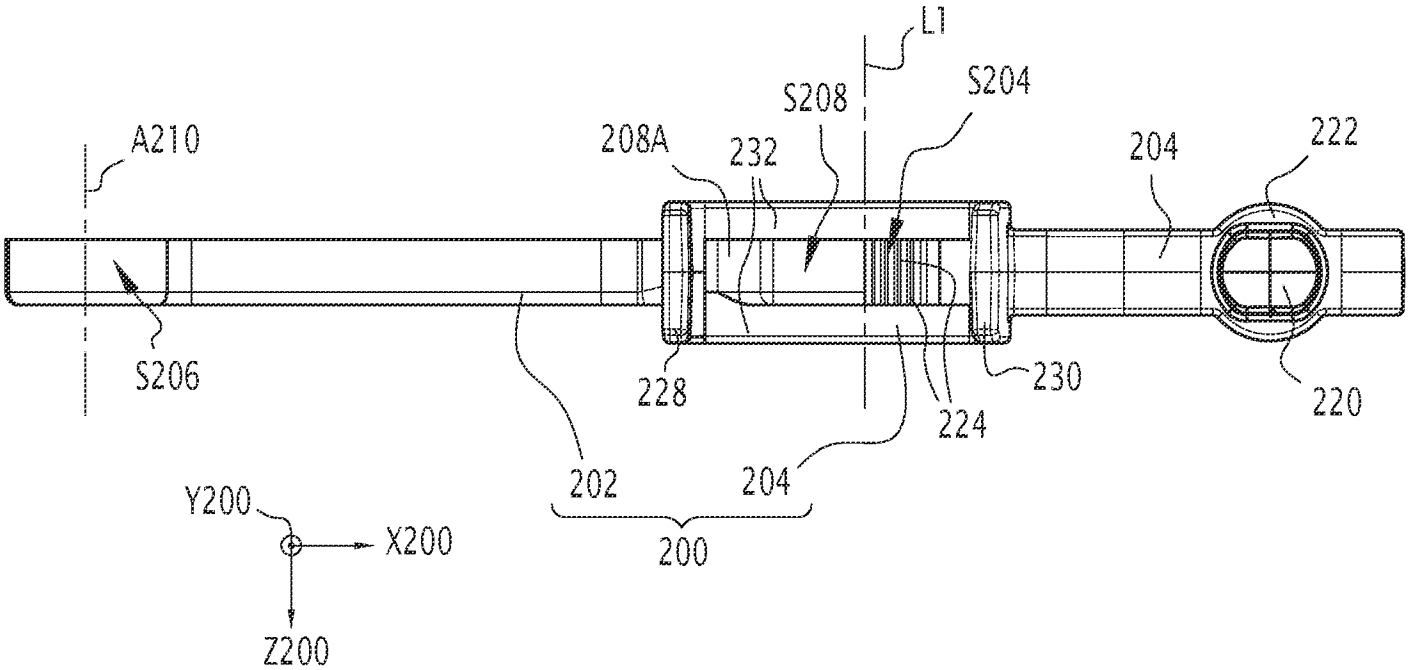
FIG. 8 is a front view, in the direction of the arrow VIII of FIG. 7, of the retaining lever.
Figure 9:
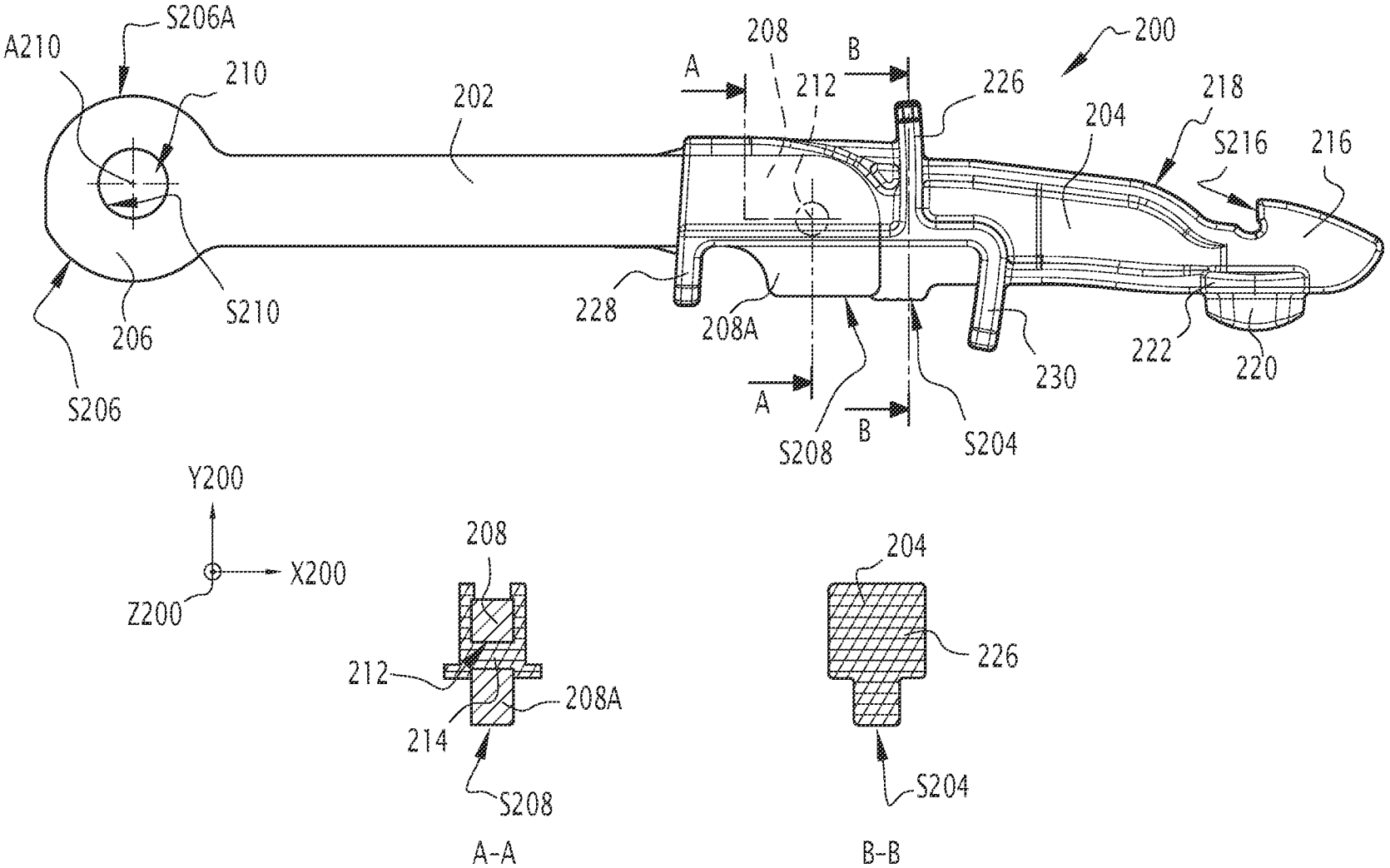
FIG. 9 is a side view of the retaining lever of FIGS. 6 and 7, with two local cross-sections A-A and B-B.

The surface S142 of a flange 142 defines, with the outer peripheral surface S144 of the adjacent guide shaft 144 and with the upper pole face S122 facing it, a volume V1 for receiving a portion of a retaining lever 200 represented alone in FIGS. 7 to 9. More specifically, the surface S144 defines the volume V1 radially to the axis A144 in a direction converging towards that axis. The surface S122 defines the volume V1 radially to the axis A144 in a direction diverging from that axis. The surface S142 defines volume V1 axially, according to a direction from a free end 144E of the shaft 144 towards the adjacent flange 142, i.e., here in a direction opposite to that of the axis Z100.

The volume V1, which is defined by the electromagnet 100, can be referred to as a partial receiving housing for the retaining lever 200.

The fact that each guide shaft 144 is formed by a portion of the electromagnet 100, in particular integrally with the frame 104, makes it possible to reduce the positioning tolerances of this guide shaft with respect to the ferromagnetic core 102, more precisely the positioning tolerances between the surfaces S144 and S122. This contributes to the precision of the geometric definition of the volume V1 and to the precision of the guidance of the retaining lever 200 relative to the ferromagnetic core 102.

The winding 106 is created by winding a wire in the form of a coil around the central stem 120 of the ferromagnetic core 102 equipped with the strips 148. This winding is created after the frame 104 has been overmolded onto the ferromagnetic core 102 so that the winding 106 is in contact with the lateral faces 120C and 120D of the central stem 120 but separated from the edges 120A and 120B by the strips 148. Each end of the wire constituting the winding 106 is connected to one of the two electrical contacts 110. The frame 104 then provides electrical insulation between the two electrical contacts 110, and electrical insulation between the core 102 and the two electrical contacts 110, including at their connection to the winding 106. Once the winding 106 is in place on the central stem 120 and connected to the electrical contacts 110, the covering 108 is applied to the parts 102, 104 and 106 by low-pressure overmolding and forms, in particular, a protective layer for the winding 106. The geometry of the covering 108 can be deduced from the comparison of FIGS. 3 and 5. The covering 108, the winding 106 and the electrical contacts are then integral with the core 102.

An orthogonal reference frame X200, Y200, Z200 related to each retaining lever 200 is defined, with an axis X200 parallel to the largest dimension of the lever 200, i.e., it forms a longitudinal axis for this lever, a transverse axis Y200, parallel to the width of the lever and a depth axis Z200, parallel to the thickness of the lever. The axis X200 is oriented downwards when the retaining lever 200 is mounted within the shedding mechanism 7.

The lever 200 comprises an armature 202 made of a ferromagnetic material, for example pure iron, and a non-magnetic body 204 integral with the armature 202. The armature 202 interacts magnetically with the first and second pole faces S122, S124, as will be apparent from the following disclosure. The armature 202 extends, parallel to the axis X200 between a first longitudinal end 206 and a second longitudinal end 208. The first longitudinal end 206 defines a first housing 210 which passes from one side to the other of it according to its thickness and which has a circular cross-section centered on an axis A210 parallel to the axis Z200. The peripheral surface of the housing 210 is noted as S210 which is an internal surface of the first end 206. The outer peripheral surface of the end 206 is noted as S206. A portion S206A of this outer peripheral surface S206 has a circular base centered on the axis A210, and this portion S206A itself forms an outer surface of the first longitudinal end 206.

The second longitudinal end 208 of the armature 202 defines a second housing 212 which also passes through this armature, according to its thickness, and in which the non-magnetic body 204 is anchored by means of a bar 214, which is integral with the rest of the non-magnetic body 204 and passes from one side to the other of the housing 212.

In practice, the non-magnetic body 204 is formed of a synthetic material, in particular a plastic material, for example of the thermoplastic polymer type, possibly reinforced with fibers, which is overmolded onto the metal armature 202 by filling the second housing 212, thus forming the bar 214. Thus, the non-magnetic body 204 has a fixed position relative to the armature 202 and is movable with the armature 202. The non-magnetic body 204 surrounds the end 208 of the armature 202 and extends it in the direction of the longitudinal axis X200, i.e., away from the first longitudinal end 206.

The non-magnetic body 204 forms a selection nose 216, a guide ramp 218 and a pin 220 surrounded, over its entire periphery, by a collar 222. The surface S216 of the selection nose facing the armature 202 and the first end 206 allows a movable hook 13 to be retained in or near its top dead center position by engaging a hole in the movable hook.

According to a transverse direction of the non-magnetic body 204 parallel to the axis Y200, the nose 216 and ramp 218 are located on one side of the body, while the pin 220 and flange 222 are located on the other side of the body. The surface portion S206A is located on the same side of the retaining lever 200 as the pin 220.

The body 204 also comprises an abutment surface S204 intended to be selectively in contact with the electromagnet 100, depending on the position of the retaining lever. The selection nose 216, the guide ramp 218 and the pin 220 are integrally formed with the abutment surface S204.

According to the longitudinal direction of the lever 200, i.e., along the axis X200, the abutment surface S204 is adjacent to an outer attracting surface S208 formed by the second end 208 of the armature 202, more particularly by a slice of a portion 208A of this second end that is not covered by the non-magnetic body 204. The abutment surface S204 is adjacent to the outer attracting surface S208 in that the abutment surface S204 and the outer attracting surface S208 share a common boundary.

The surfaces S206A and S208 are in electrical continuity as the armature 202 extends seamlessly between these surfaces. This follows, in particular, from the fact that, in this example, the armature 202 is one-piece.

The portion 208A of the end 208 that defines the outer attracting surface S208 is the portion of the armature 202 the furthest from the first end 206.

The armature 202 extends, in the direction of the axis X200, from the first end 206 to the junction of the outer attracting surface S208 with the abutment surface S204. In other words, the armature 202 does not extend a significant length within the non-magnetic body 204 beyond the portion 208A.

The abutment surface S204 is generally flat and parallel to the axes X200 and Z200, and is equipped with transverse grooves 224, parallel to the axis Z200, which are juxtaposed according to the longitudinal direction of the lever which is parallel to the axis X200. These grooves 224 have the effect that the surface S204 is not smooth but notched because it is formed by a juxtaposition of strips of material separated by the grooves 224.

The deflectors are formed by the non-magnetic body 204 and are integral with the rest of this body. A first deflector 226 extends around the non-magnetic body 204, longitudinally at the same level as the abutment surface S204 but opposite this surface according to the direction of the transverse axis Y200. Two other deflectors 228 and 230 are formed by the non-magnetic body 204 on the same side as the abutment surface S204 but at different levels according to the longitudinal axis X200, on either side of this surface according to this axis X200. More specifically, the deflector 228 is located according to the axis X200, between the first longitudinal end 206 and the abutment surface S204, while the second deflector 230 is located according to the axis X200 between the abutment surface S204 and the pin 220. Joining strips 232 connect the deflectors 228 and 230 according to the longitudinal direction of the retaining lever 200. These joining strips 232 are located, according to the axis Z200, on either side of the surfaces S204 and S208. The deflector 226 connects to the joining strips 232.

Thus, the deflectors 226, 228 and 230 are in continuity with each other. In particular, the deflectors 228 and 230 and the joining strips 232 form a continuous edge around the surfaces S204 and S208 as viewed in the direction of the arrow VIII in FIG. 7. The deflector 226 is located on the same side of the non-magnetic body 204 as the selection nose 216, while the pair of deflectors 228 and 230 are located on the same side as the abutment surface S204 and the outer attracting surface S208. In addition, the deflector 226 is located longitudinally, i.e., according to the axis X200, between the deflectors 228 and 230.

The shedding mechanism 7 also comprises one or more unitary housings 300 that are part of the housing 10. The number of housings 300 that are part of the shedding mechanism 7 depends on the number of electromagnets 100. In practice, as many unitary housings 300 are provided as electromagnets 100.

An orthogonal reference frame X300, Y300, Z300 is related to each unitary housing 300, which is defined by a longitudinal axis X300, a transverse axis Y300 and a depth axis Z300 of the unitary housing 300, respectively.

Figure 10:
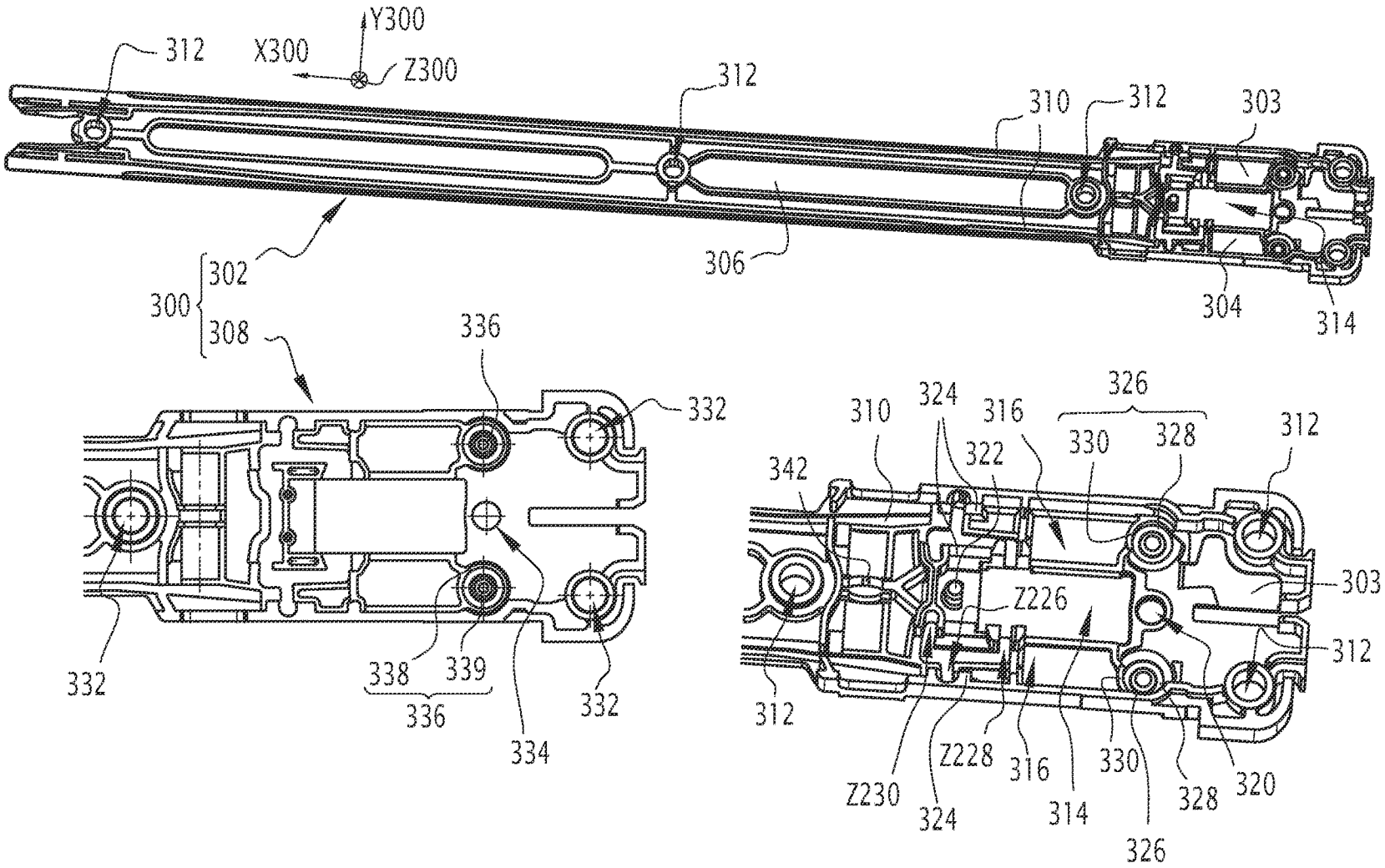
FIG. 10 is a perspective view of a housing of the shedding mechanism of FIG. 1 with, in enlarged detail views, an area of this housing provided for receiving the electromagnet and a corresponding portion of a housing cover.

Each unitary housing 300 comprises a half-shell 302 visible in its entirety in the upper portion of FIG. 10 and which delimits a portion 304 for receiving a selection device 400 formed by an electromagnet 100 and two related retaining levers 200, and a guide portion 306 for the two mobile hooks 13 intended to be selected by means of the selection device.

The unitary housing 300 shown in the figures, with its electromagnet 100, comprising two pairs of first and second pole faces, and its two retaining levers 200 arranged on either side of the electromagnet according to the axis Y100, is used in two-position Jacquard-type shedding mechanisms used for weaving so-called "flat" fabrics.

The receiving portion 304 is shown in larger scale at the lower right portion of FIG. 10, while a portion of a cover 308, corresponding to the portion 304, is shown at the lower left portion of FIG. 10. The half-shell 302 and the cover 308 together constitute a unitary housing 300.

The bottom 303 of the half-shell 302, which is parallel to the axes X300 and Y300, presents longitudinal grooves 310 for guiding the movement of the blades 504 that belong to the movable hooks 13. This bottom is also pierced with holes 312 for the passage of rods or screws for joining several housings 300 belonging to a stack of unitary housings of the shedding mechanism 7 that together form all or part of the housing 10.

In this portion 304, the unitary housing 300 defines a recess 314, which passes through the bottom 303 and delimits a volume for partially receiving the electromagnet 100, and two zones 316 for receiving two retaining levers 200 related to the electromagnet 100.

The bottom 303 of the half-shell 302 is traversed, from one side to the other according to the direction of the axis Z300, by a centering housing 320 of circular shape and intended to receive the centering pin 146 in the mounted configuration of the electromagnet 100 in the unitary housing 300. This centering housing has a geometry complementary to that of the centering pin 146.

A centering pin 322 projects from the bottom 303, parallel to the axis Z300, and is located along the axis X300 between the recess 314 and the guide portion 306. This centering pin 322 is located opposite the centering housing 320 relative to the recess 314. This centering pin is intended to be engaged in the centering notch 126 of the ferromagnetic core 102 in the mounted configuration of the electromagnet 100 in the unitary housing 300.

The unitary housing 300 also forms baffles 324 in each area 316 for receiving a retaining lever 200.

On either side of the centering housing 320 according to the transverse direction Y300, the unitary housing 300 defines a housing 326 in the form of a portion of a cylinder with a circular cross-section for receiving a flange 142 of the electromagnet 100. Each housing 326 is defined by an annular surface 328 and by a rib 330 the inner surface of which is cylindrical in shape with a circular cross-section and complementary to the outer peripheral surface S'142 of a flange 142 of the electromagnet 100.

The cover 308, the face of which is visible in FIG. 10, is that which normally faces the bottom 303 of the half-shell 302, defines the holes 332 for the passage of fastening pins or screws, these holes 332 being aligned with the holes 312 in the mounted configuration of the cover 308 on the half-shell 302. This cover 308 also defines a centering recess 334 that is aligned with the centering recess 320 in the mounted configuration of the cover 308 on the half-shell 302. Alternatively, the cover 308 may not include a centering recess 334. This cover 308 further defines two recessed housings 336, each formed by an annular planar surface 338 and by a rib 339. These recessed housings 336 are respectively aligned with one of the housings 326 in the mounted configuration of the cover 308 on the half-shell 302.

The elements 302 and 308 are made by injection molding of electrically insulating polymeric material, optionally reinforced with fibers to improve their mechanical properties. The elements 302 and 308 are non-magnetic.

In the mounted configuration of a retaining lever 200 on the electromagnet 100, the first longitudinal end 206 of the metal armature 202 is mounted around one of the guide shafts 144. To this end, the axes A144 and A210 are coincident, the surfaces S144 and S210 face each other radially to the axis A144, and the respective dimensions of the surfaces S144 and S210 are selected to allow each retaining lever 200 to pivot about the oscillation axis X144 while effectively guiding this pivotal movement.

In the mounted configuration of a selection device 400, the orthogonal reference frame X100, Y100, Z100 and each orthogonal reference frame X200, Y200, Z200 are generally coincident, neglecting the amount of oscillation of a retaining lever 200 about the axis A144 of the guide shaft about which the retaining lever 200 is mounted.

In the mounted configuration of the selection device 400 in the unitary housing 300, each retaining lever 200 extends generally according to the longitudinal direction of the unitary housing 300, i.e., parallel to the axis X300, downwards from the first end 206 of that retaining lever. In this configuration, the orthogonal reference frames X100, Y100, Z100, X200, Y200, Z200 and X300, Y300, Z300 are generally coincident.

Figure 11:
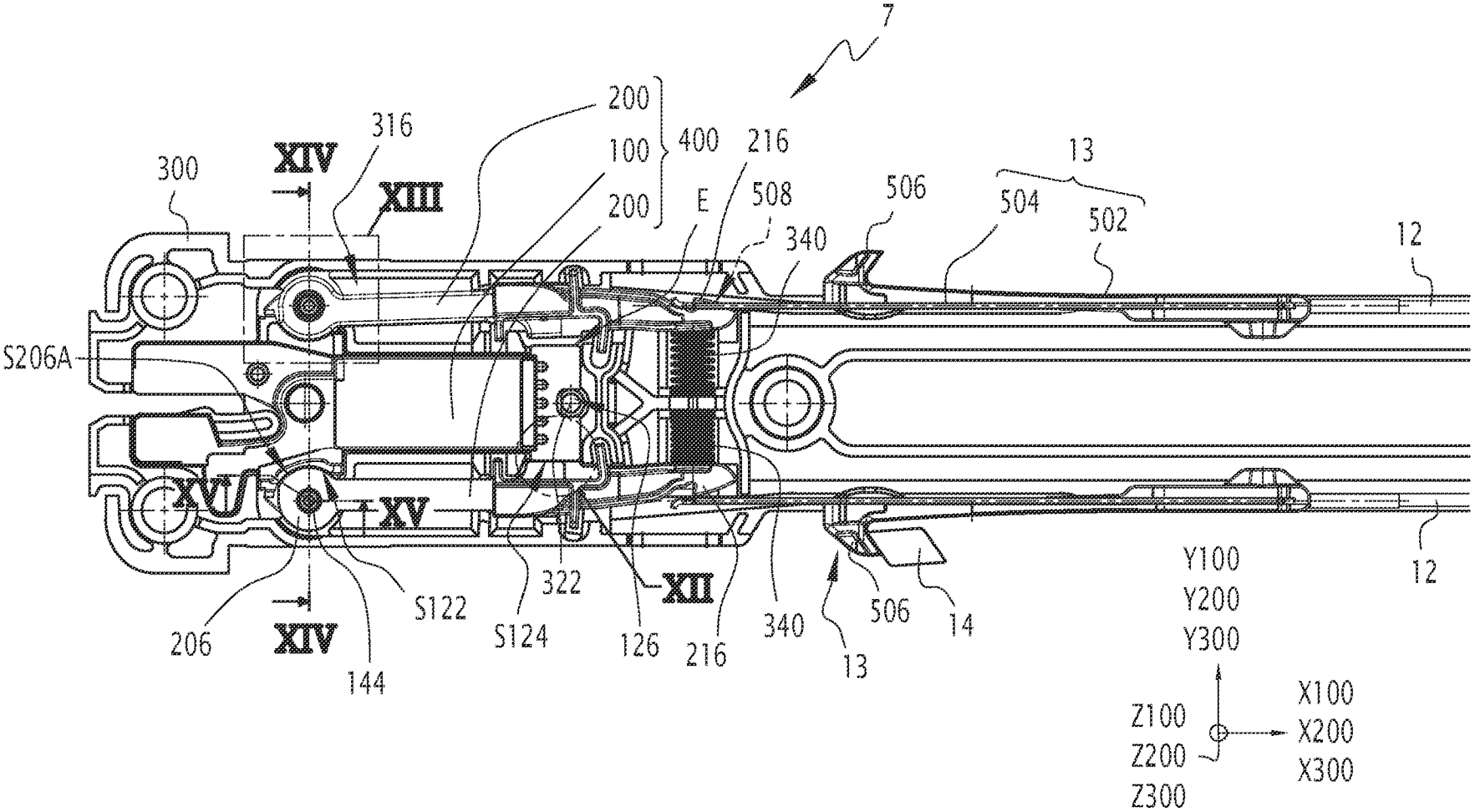
FIG. 11 is a partial front view of the housing equipped with a selection device, consisting of the electromagnet and two retaining levers, as well as two movable hooks.
Figure 12:
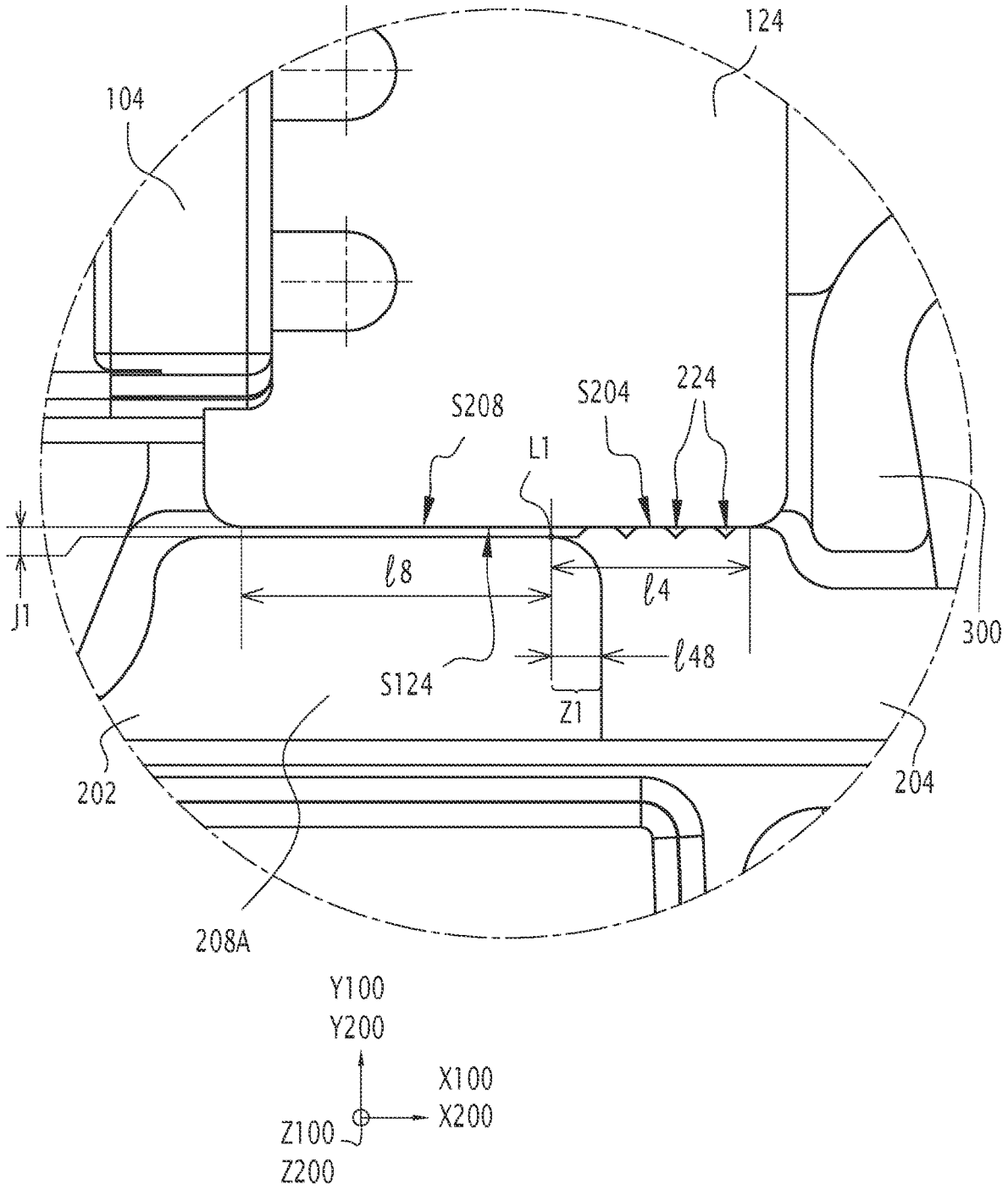
FIG. 12 is a larger scale view of detail XII of FIG. 11.
Figure 13:
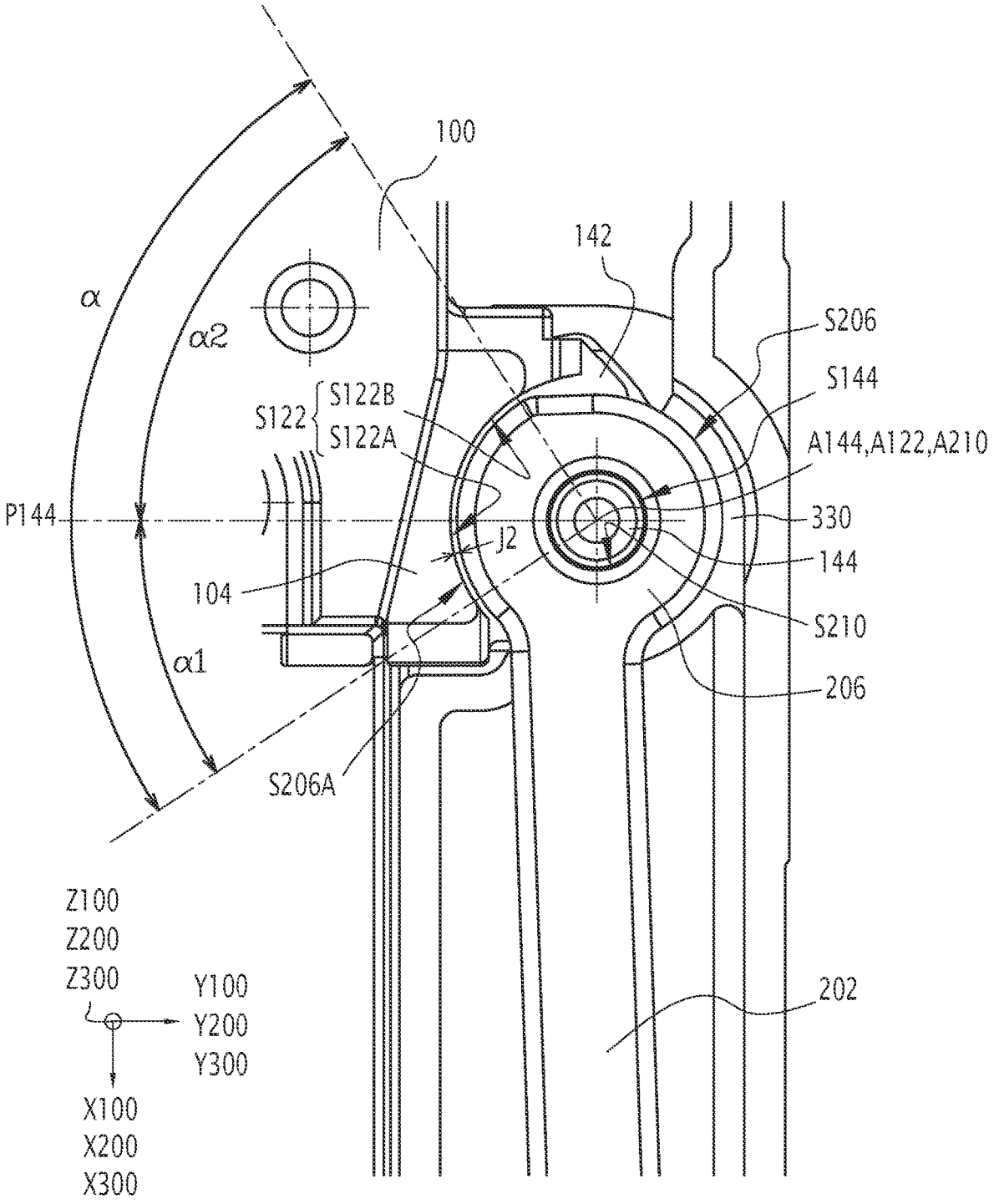
FIG. 13 is a larger scale view of detail XIII of FIG. 11.

In this mounted configuration shown in FIG. 11 and following, the outer attracting surface S208 of each retaining lever 200 faces one of the lower pole faces S124 of the electromagnet 100 parallel to the axis Y100.

Each retaining lever 200 is movable, about the axis A144 of the guide shaft 144 about which the first longitudinal end 206 of its armature 202 is mounted, between a position in contact with the electromagnet, in the example, in contact with the lower branch 124 of the ferromagnetic core 102, and a position remote from the electromagnet in which an empty space E of non-zero dimensions according to the axes X100, Y100, and Z100 exists between the electromagnet, in the example the lower branch 124, and the lever 200. In particular, the depth of the empty space E, which is measured according to the Y axis, is non-zero in the remote position of the retaining lever 200 relative to the electromagnet 100. In practice, the terms "remote" and "in contact with" used to define the positions of the retaining lever relative to the electromagnet relate to the remote or in contact with nature of its abutment surface S204 relative to the electromagnet. The retaining lever 200 shown in the lower portion of FIG. 11 is in contact with the electromagnet, while the lever 200 shown in the upper portion of FIG. 11 is in a position remote from the electromagnet.

In the configuration of a lever 200 in contact with the electromagnet 100, the surface S204 is in contact with a lower pole face S124, to the extent that it limits the pivoting movement of the lever 200 shown in the lower portion in FIG. 11, in the trigonometric direction about the axis A144 of the guide shaft 144 on which this lever 200 is pivotally mounted.

In this contact position, the outer attracting surface S208 is not in contact with but at a distance from the lower pole face 124, in that there is a transverse gap J1 of non-zero dimension between the surfaces S208 and S124. The dimension of the gap J1 is measured parallel to the axes Y100, Y200 and Y300. The presence of the gap J1 of non-zero dimension along the entire length of the surface S208 along the axis X100 and along the entire thickness of the surface S208 taken according to the axes Z100, Z200, Z300 means that an air gap exists between the surfaces S124 and S208. This is due to the fact that, on the retaining lever 200, the abutment surface S204 protrudes, relative to the outer attracting surface S208, in the direction of the electromagnet 100. In other words, the abutment surface S204 projects transversely, according to a direction parallel to the Y200 axis and facing the electromagnet in the mounted configuration of the retaining lever 200, relative to the outer attracting surface S208, and this abutment surface S204 comes into contact with the second pole face S124 keeping the outer attracting surface S208 at a distance from the second pole face S124 when the lever 200 pivots from its position remote from the electromagnet to its position in contact with the electromagnet.

The surface S208 is an outer attracting surface in that, when lever 200 is in its position in contact with the electromagnet 100 and when that electromagnet is energized, the magnetic attraction force between the ferromagnetic core 102 and the metal armature 202 is exerted through this surface S208.

It is noted in FIG. 9 that the armature 202, particularly the portion 208A of the end 208, does not extend longitudinally across the entire abutment surface S204.

The outer attracting surface S208 is arranged longitudinally relative to the retaining lever 200, i.e., along the axis X200, between the abutment surface S204 and the axis A210. The length $\ell$ 8 of the outer attracting surface S208 is greater than the length $\ell$ 4 of the abutment surface S204 that faces the lower pole face S124 in the contact position of the retaining lever 200 and forms the contact area between the surfaces S204 and S124. The lengths $\ell$ 4 and $\ell$ 8 are measured parallel to the axis X200. In the embodiment shown in FIGS. 1 to 15, the entire abutment surface S204 faces the lower pole face S124 in the contact position of the retaining lever 200. However, it is conceivable that only a portion of this surface S204 comes into contact with the lower pole face S124 or faces the lower pole face S124. In this case, it is the length $\ell$ 4 of this portion of the surface S204 which comes into contact with the pole face S124, which also forms a contact area between the surfaces S204 and S124, which is chosen to be less than the length $\ell$ 8.

Note $\ell$ 48 the length, measured parallel to the axis X200, over which the metal armature 202 of the retaining lever 200 extends, starting from the end 206, beyond a line L1 that delimits the boundary between the surfaces S208 and S204 in a plane parallel to the plane of FIG. 8. This line L1 is perpendicular to the plane of FIG. 12 and makes visible, on the face of the retaining lever 200 shown in FIG. 8, the junction area Z1 between the parts 202 and 204. The length $\ell$ 48 thus corresponds to the overlap length of the second longitudinal end 208 by the abutment surface S204. The ratio $\ell$ 48/$\ell$ 4 is less than 0.2. In other words, the abutment surface S204 overlaps the armature 202 for less than one-fifth of the length $\ell$ 4 of the useful portion of the abutment surface S204, which serves to hold it against the electromagnet. This results in the portion of the non-magnetic body 204 that constitutes the abutment surface S204, the selecting nose 216, the guide ramp 218, and the pin 220 forming a lower end of the retaining lever 200 that is substantially free of metal armature below the outer attracting surface.

In the mounted configuration of the selection device 200 in the unitary housing 300, the deflectors 226, 228 and 230 are engaged in the receiving areas Z226, Z228 and Z230 formed by the baffles 324. Thus, the cooperation of the deflectors and the baffles isolates certain internal portions of the unitary housing 300 equipped with the selection device 400 from the guide portion 306, thereby protecting these parts from the accumulation of dust, sludge or grease.

In the mounted configuration of the selection device 400 in the unitary housing 300, a compression coil spring 340 is interposed between a central rib 342 of the housing 300 and the non-magnetic body 204 of a retaining lever 200. Each spring 340 has the function of returning by default the retaining lever 200 against which it pushes to its position remote from the electromagnet 100. On the side of this non-magnetic body, the pin 220 is engaged inside the spring 340 and makes it possible to center this spring, while the collar 222 makes it possible to accommodate the terminal coil of the spring all around the support pin 220. As the collar 222 surrounds the pin 220 around its entire periphery, the end coil of the spring 340 necessarily rests on this collar 222 without risk of this end coil slipping on the side of the pin 220, which guarantees the repeatability of the return force of the spring 340.

Each movable hook 13 comprises a body 502 made of plastic material and a flexible blade 504 mounted on the body 502. The flexible blade, which is preferably metallic, is intended to come into sliding abutment against the guide ramp 218 of a retaining lever 200 and includes an opening 508, visible in dotted line in FIG. 11 and known per se, into which the selecting nose 216 of the retaining lever 200 in question may be engaged. Here, use may be made of the features of the movable hook described in EP-A-1852531 or in EP-A-1413657.

In the lower portion, each body 502 is overmolded onto an end of the cord 12 that supports the muffle 11. Each body 502 defines a support bracket 506 on a knife 14. To this end, each support bracket 506 projects laterally from the unitary housing 300 in which the movable hook 13 rests, in a form-fitting manner, on the upper face of the knife.

In the mounted configuration of FIGS. 11 to 15, the first longitudinal end 206 is partially received in the volume V1. As can be seen more particularly in FIG. 13, the surface portion S206A is located opposite the first pole face S122 formed by the ferromagnetic core 102, these opposite surfaces being in the form of a portion of a cylinder with a circular base centered on the axes A122, A144 and A210, which are then merged. These surfaces delimit between them a gap J2, radial to the axes A122, A144 and A210. This radial gap J2 has a non-zero width, this width being measured radially to the axes A122, A144 and A210. This radial gap J2 defines an air gap between the surfaces S122 and S206A In practice, the radial width of the air gap defined by the gap J2 can be between 0.1 and 0.2 millimeters (mm), preferably of the order of 0.15 mm.

P144 is a transverse plane parallel to the axes Y100, Y200 and Y300, on the one hand, and Z100, Z200 and Z300, on the other hand, and perpendicular to the axes X100, X200 and X300, and containing the axes A122, A144 and A210.

The air gap defined by the radial gap J2 extends around the axis A122 over an overall angular sector of angle at the apex a. A first portion of this overall angular sector is located below the transverse plane P144, on the side of the second pole face S124 relative to that plane and presents an angle at the apex $\alpha 1$. A second portion of this overall angular sector is located above the transverse plane P144, i.e., opposite the second pole face S124, and presents an angle at the apex $\alpha 2$. The sum of the angles $\alpha 1$ and $\alpha 2$ is equal to the angle $\alpha$. The angles $\alpha$, $\alpha 1$, and $\alpha 2$ show the angular magnitudes of the overall angular sector and its first and second parts, respectively. In other words, each first pole face S122 of the electromagnet 100 extends on either side of the transverse plane P144 and comprises a first portion S122A located, relative to this plane, on the same side as the second pole face S124 and which presents an angular amplitude $\alpha 1$, as well as a second portion S122B located, relative to this plane, on the opposite side from the second pole face S124 and which presents an angular amplitude $\alpha 2$.

The ratio $\alpha 1/\alpha$ is between 0.2 and 0.4 preferably equal to 0.33. In this preferred case, the ratio $\alpha 1/\alpha 2$ is 0.5.

The good geometric precision obtained at the air gap defined between the surfaces S122 and S206A allows the size of these surfaces to be optimized. In particular, the ratio between the diameter of the surface S122 and the diameter of the surface S144 can be chosen to be greater than 1.4, preferably of the order of 1.5. This good precision also allows the first and second pole faces S122 and S124 to be spaced apart according to the longitudinal direction parallel to the axis X100 or the axis X300, without penalizing the longitudinal dimensions of the electromagnet. This results in the amplitude of the angular pivoting movement of a retaining lever 200 about the oscillation axis A144 being relatively small between the remote position and the contact position, to the extent that the air gap at a lower pole face S124 has a width measured according to the axis Y100, Y200, Y300 that varies little along the length of the outer attracting surface S208. This good precision further allows the outer diameter of the guide shaft 144, and thus the outer dimensions of the first longitudinal end 206, to be reduced, thereby reducing metal loss during the manufacture of the metal armature 202.

During the manufacture of the shedding mechanism 7, the frame 104 is overmolded onto the ferromagnetic core 102, followed by the installation of the winding 106, the installation of the contacts 110 and the connecting wires between these contacts and the winding 106, and then the overmolding of the covering 108. The electromagnet 100 thus manufactured, with its guide shafts 144, is inserted and fixed in the half-shell 302 of the unitary housing 300. The electromagnet 100 is inserted into the recess 314 according to a direction parallel to the axis Z300, by inserting the centering pin 146 into the centering recess 320 of the unitary housing 300. The centering pin 146, which is located between the two upper pole faces S122 and at an equal distance therefrom, allows, through its fitting into the bottom 303 of the half-shell 302 of the unitary housing 300, to ensure the positioning of the electromagnet 100 in the unitary housing 300, both in the longitudinal and transverse directions respectively parallel to the axis X300 and the axis Y300.

In addition, the centering notch 126 of the ferromagnetic core 102 is positioned, without play in the lateral direction parallel to the axis Y300, around the complementarily shaped centering pin 322 located on the half-shell 302.

The winding 106 of the electromagnet 100 is then aligned with the recess 314 provided through the bottom of the housing parallel to the axis Z100.

The frame 104 of the electromagnet 100 is then supported on two support surfaces of the bottom 303 of the half-shell 302, one arranged between the lower pole faces S124, the other arranged between the upper pole faces S122.

Figure 14:
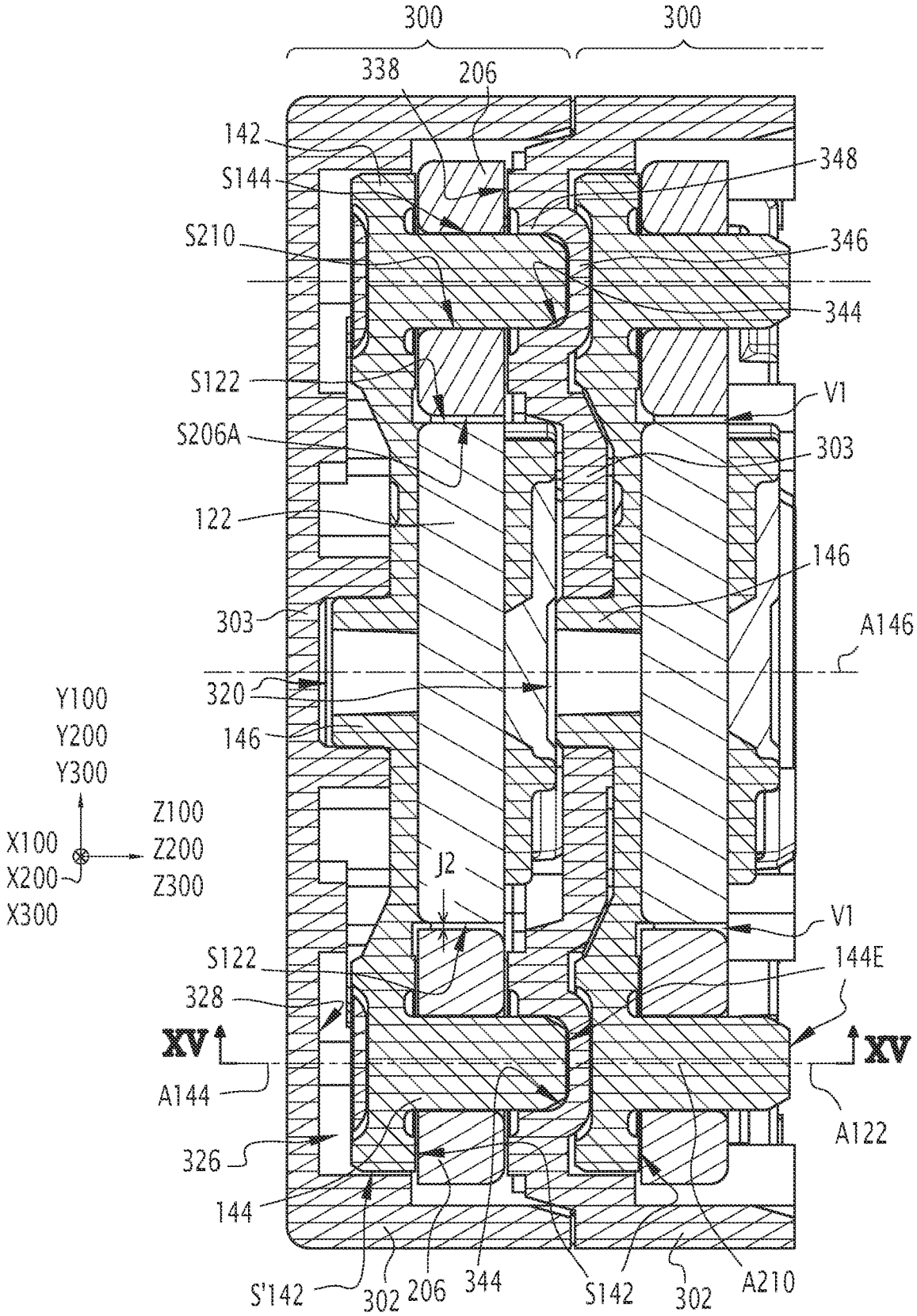
FIG. 14 is a larger scale cross-section, corresponding to the line XIV-XIV of FIG. 11, in a stack of housings belonging to the shedding mechanism of the weaving loom of FIG. 1.
Figure 15:
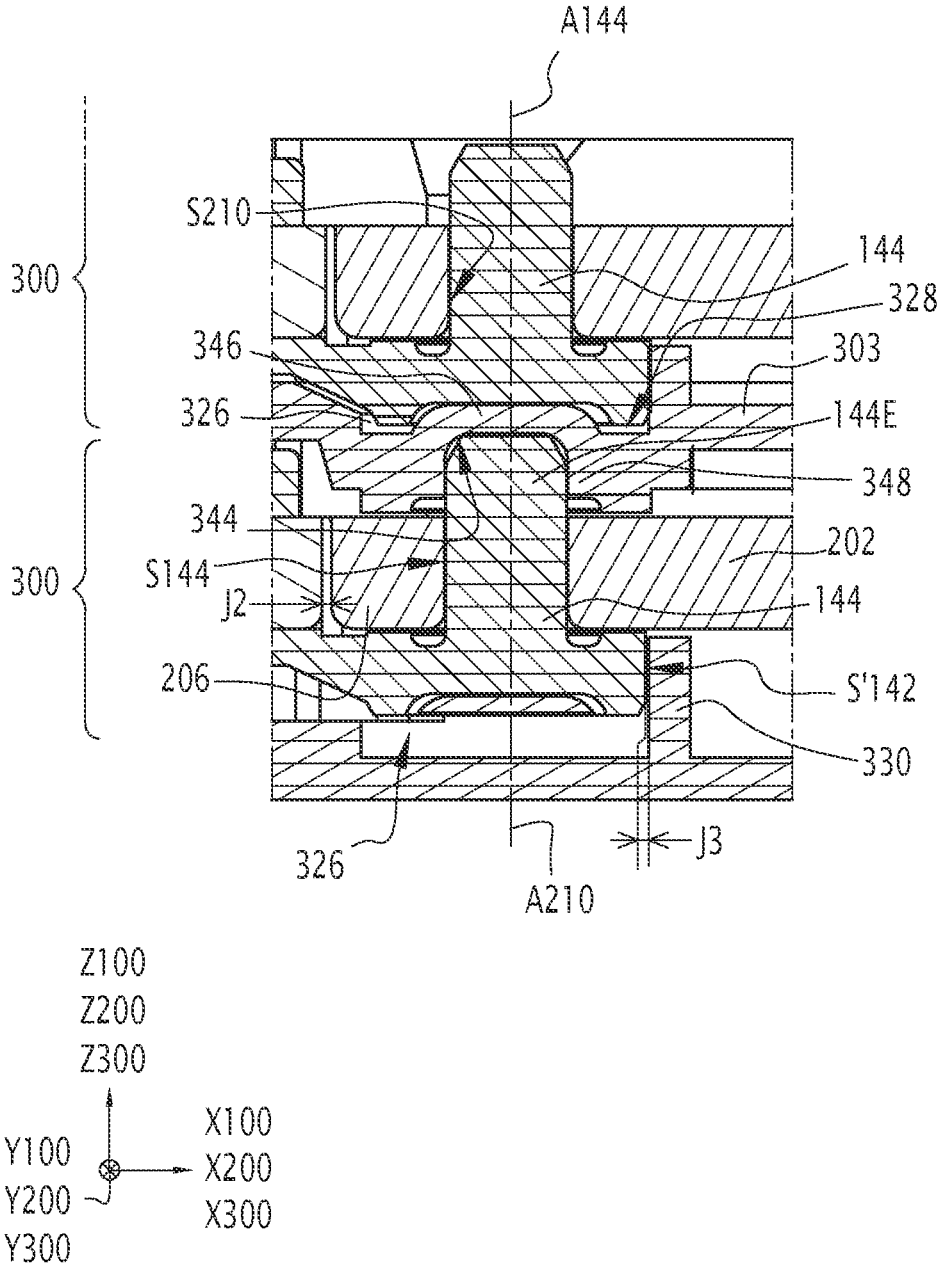
FIG. 15 is a partial cross-section according to the line XV-XV of FIG. 14.

The outer peripheral surface S'142 of the flange 142 is a radial outer surface in a portion of a cylinder centered on the shaft 144 which is then coincident with the axis A122. During mounting of the electromagnet 100 in the unitary housing 300, each flange 142 of the electromagnet 100 is engaged in a housing 326 of the unitary housing 300, as shown in FIGS. 14 and 15. The radially outer surface S'142 of a flange 142 then faces the corresponding rib 330 in the plane of FIG. 15, according to a longitudinal direction parallel to the axes X100, X200, and X300 that is vertical and directed downwards. A portion of the rib 330 is therefore arranged opposite the surface S'142 according to the longitudinal direction. A reduced longitudinal gap J3 is defined between the outer peripheral surface S'142 and the rib 330 in the plane of FIG. 15. This gap J3 is therefore vertical and presents, in practice, a non-zero width when the electromagnet 100 is placed in the unitary housing 300 in order to prevent this placement from creating a hyperstatic situation. The width of the gap J3 is measured parallel to the axis X300. The width of the gap J3 is less than or equal to 0.5 mm.

After mounting the electromagnet 100 in the half-shell 302 and in the operating configuration of the mechanism 7, the oscillation axes A144 are fixed relative to the half-shell 302 and the electromagnet 100. The free ends 144E of the guide shafts 144 extend away from the bottom 303 of the half-shell 302. In other words, the two guide shafts 144 extend with their axes A144 parallel to the axis Z300 and are perpendicular to the bottom 303 of this half-shell.

The retaining levers 200 are then positioned around the guide shafts 144 of the frame 104 with a first longitudinal end 206 of each retaining lever 200 surrounding a guide shaft 144. To do this, the axis A210 of each retaining lever 200 is aligned with the axes A122 and A144, then the first longitudinal end 206 of the armature 202 is partially engaged in the volume V1, by an axial translation parallel to the axes A122, A144 and A210, until it comes into abutment against the surface S142 of one of the flanges 142. This is equivalent to hooking the retaining levers onto the electromagnet in place in the unitary housing. The orientation of a retaining lever is chosen so that the portion S206A of the outer surface S206 of each first longitudinal end 206 then faces an upper pole face S122. On the other hand, due to this placement, each outer attracting surface S208 faces a lower pole face S124 of the electromagnet 100, according to the transverse direction parallel to the axes Y100, Y200 and Y300.

Since the first pole faces S122 and the second pole faces S124 are offset and spaced apart according to the longitudinal direction, a longitudinal portion of the metal armature 202 of each retaining lever 200 is neither facing the first pole face S122 nor facing the second pole face S124 but located longitudinally at the level of the central stem 120 of the core 102 and the winding 106.

When mounting the retaining levers 200 in the unitary housing 300 equipped with the electromagnet, the deflectors 226, 228 and 230 of the non-magnetic body 204 are engaged in the areas Z226, Z228 and Z230 defined by the baffles 324, during the aforementioned axial translation.

Following the installation of the two retaining levers 200 on the electromagnet 100, these retaining levers are connected to the remainder of the selection device 400 and are each movable in rotation about an axis A144 that is fixed relative to the unitary housing 300 since the electromagnet 100 is immobilized in the unitary housing 300.

The outer radial surfaces S144 of the guide shafts 144 thus form cylindrical guide surfaces that cooperate, with reduced play, with the retaining levers 200, more particularly with the surfaces S210 of the housings 210, in their pivoting movement about their oscillation axis A144. By reduced gap is meant a radial gap at the oscillation axis A144 that is strictly less than the gap J2, to ensure a non-zero air gap between the surface S206 and the adjacent first pole face S122, and thus the absence of contact between the armature 202 of the lever 200 and the pole face S122, between the remote position and the position in contact with the retaining lever. The guide surfaces S144 are formed on the non-magnetic portion of the electromagnet. Each guide shaft 144 forms a point of attachment for a lever 200 to the housing 300, the point of attachment being fixed relative to the electromagnet 100.

The cooperation of the deflectors 226 and 228 with the areas Z226 and Z228 defined by the baffles 324 isolates the area of the housing that contains the first longitudinal end 206 of the armature 202 of each lever and the related guide shaft 144, this area being dedicated to the articulation of the lever 200 to the electromagnet 100. This makes it possible to maintain the lubrication of the pivotal linkage made between the surfaces S144 and S210, which can be greased.

The cooperation of the deflectors 228 and 230 with the areas Z228 and Z230 defined by the baffles 324 also makes it possible to isolate an attraction area defined between, on the one hand, the lower pole face S124 and, on the other hand, the outer attracting surface S208 and the abutment surface S204. This keeps this attraction area free of grease and dust to ensure a satisfactory air gap between the lower pole face S124 and the outer attracting surface S208 when the retaining lever 200 is in its position in contact with the electromagnet.

Both retaining levers 200 can then oscillate about their respective guide shafts 144, between the remote and contact positions shown at the top and bottom, respectively, of FIG. 11. In a manner known per se, this allows the movable hooks 13 to be selectively retained in position, based on a command to the electromagnet 100 by the electrical contacts 110.

The movable hooks 13 and the cords 12 can then be positioned in the guide portion 306 of the half-shell 302. Alternatively, the movable hooks 13 and cords 12 are placed in the half-shell before the elements 100 and 200.

After the retaining levers 200 are placed on the electromagnet 100, which is itself in place in the unitary housing 300, the free ends 144E of the guide shafts 144, protrude from the retaining levers 200 in a direction parallel to the axes Z100, Z200 and Z300. The half-shell 302 can then be covered with the cover 308, with the half-shell 302 and the cover 308 stacked along the axis Z300, by aligning the holes 332 with the holes 312 and the housings 336 with the free ends 144E of the guide shafts 144. The connecting rods or screws are then placed in the holes 312 and 332.

It is also possible to superimpose the half-shells 302 each equipped with a selection device 400, with the bottom 303 of one half-shell serving as a cover for the adjacent half-shell, and to use a cover 308 only for the last half-shell 302. This configuration is shown in part in FIGS. 14 and 15. In this case, the holes 312 of the half-shells 302 are superimposed and the connecting rods or screws are then placed in these holes.

Consider an electromagnet 100 mounted in a first half-shell 302 that is part of a first unitary housing 300. In this case, the free end 144E of a guide shaft 144 of this electromagnet is engaged in a correspondingly shaped housing 344 provided on the bottom surface 303 of a second adjacent half-shell 302, which covers the first half-shell 302 by stacking the two half-shells 302 according to the axis Z300. The housing 344 is used here in place of a housing 336 of the cover 308. The first unitary housing is formed by the first half-shell and the bottom 303 of the second half-shell. The same is true for the other unitary housings, except for the last one which is covered by the cover 308. The recessed housing 344 is arranged on the side of the bottom 303 of the second half-shell 302 opposite the electromagnet 100 contained in that half-shell. The bottom 346 of the recessed housing 344 of the second half-shell is in contact with the free end 144E of the guide shaft 144 in a direction parallel to the axis Z300. In addition, the cylindrical wall 348 that defines the housing 344 is substantially complementary to the outer peripheral surface S144 of the guide shaft 144, thereby centering each guide shaft in the second half-shell 302 of the second unitary housing 300.

FIGS. 14 and 15 show that the bottom of the first half-shell of the unit housing stack is not provided with a recessed housing 344, which would be unnecessary.

On the other hand, the flat, annular surface 338 formed by the bottom 303 of the second half-shell 302 and surrounding the recessed housing 344 faces the flange 142 of the electromagnet received in the first half-shell. The first end 206 of the armature 202 is located between the surfaces S142 and 338 which face each other according to a direction parallel to the axis Z300. In other words, the surface 338 serves as a cover for the volume V1 in which the armature 202 is partially received.

If the cover 308 is used, it is the flat, annular surface 338 of a recessed housing 336 that closes the volume V1.

In the stacking configuration shown in FIGS. 14 and 15, the housings 300 are centered relative to each other in the longitudinal and transverse directions parallel to the axes X300 and Y300 and are in contact with each other in the axis Z300 direction.

In operation, each electromagnet 100 selectively controls, by means of the two retaining levers 200 related thereto, the retention or release of either of the two movable hooks 13 that are arranged on either side of that electromagnet in the same unitary housing 300. In FIG. 11, the two movable hooks 13 are shown near the dead center of their trajectory. The movable hook 13 visible in the upper part of FIG. 11 is hooked onto the corresponding retaining lever 200, by inserting the selection nose 216 of this retaining lever into a hole 508 of the blade 504 of this movable hook, which is possible because this retaining lever 200 is in a position remote from the electromagnet 100. The movable hook 13 shown in the lower portion of FIG. 11 is clear of the selection nose 216 of the corresponding retaining lever, which is held in a contact position, to the extent that its selection nose 216 is not in the path of the upper end of the blade 504 of this movable hook.

In the vicinity of the top dead center of its trajectory, the blade 504 of each movable hook 13 comes into contact with the guide ramp 218 of the corresponding retaining lever 200 and exerts on this lever a lateral force directed towards the electromagnet, parallel to the axis Y100, against the force exerted by the spring 340 engaged around the pin 220 of this retaining lever. This lateral force causes the retaining lever to pivot about its oscillation axis A144 from its remote position, shown in the upper portion of FIG. 11, to its contact position, shown in the lower portion of this figure. This operation constitutes the leveling of the retaining levers 200.

During this displacement of each retaining lever 200, between its position remote from the electromagnet 100 and its position in contact with this electromagnet, the upper air gap, defined by the radial gap J2, remains identical, with a non-zero value. During this displacement, the lower air gap, defined between the outer attracting surface S208 and the lower pole face S124 decreases until it presents a non-zero width by the gap J1 in FIG. 12. The non-zero value of the lower air gap is well controlled by the fact that the surfaces S204 and S208 are both carried by the retaining lever 200 and by the contact of the abutment surface S204 against the electromagnet, in particular at the level of its lower pole face S124 opposite which the outer attracting surface S208 is arranged.

The value of the gap J1 is chosen as a function of the magnetic force to be exerted on the retaining lever 200 to keep it in a contact position against the electromagnet 100, which depends, among other things, on the magnetic properties of the armature 202 and the stiffness constant of the spring 340. In practice, the value of the gap J1 is between 0.01 and 0.06 mm, preferably between 0.025 and 0.05 mm, more preferably around 0.04 mm.

If the electromagnet 100 is energized when the retaining lever is in the contact position, a magnetic attraction force is applied between the surfaces S124 and S208. A magnetic circuit passing through the upper and lower air gaps and through the metal armature 206 of the retaining lever 200 holds this lever in contact with the lower pole face S124, against the elastic force exerted by the spring 340. In this case, the nose 216 of the retaining lever 200 does not interfere with the downward movement of the blade 504 of the movable hook 13, which follows the downward movement of the knife 14. On the contrary, if the electromagnet is not energized when the retaining lever is in its contact position between the electromagnet, the retaining lever is not held in contact with the electromagnet and, under the effect of the elastic force exerted by the spring 340, this retaining lever pivots to its position remote from the lower pole face S124 when the movable hook descends with the knife. In this case, the selection nose 216 engages in the hole 508 provided in the blade 504, to retain by its surface S216 the movable hook 13 in the upper position, close to the top dead center of its trajectory, despite the downward movement of the knife 14.

Thus, the metal armature 202 of each retaining lever 200 is configured to interact with the pole faces S122 and S124 of the electromagnet 100, depending on the activation of this electromagnet, in order to control the angular position of this retaining lever relative to the electromagnet, about its oscillation axis A144. This makes it possible to select, i.e., to hold in an upper position, or to release, i.e., to let down, a movable hook 13 resting on a knife 14, at the beginning of its downward movement. In particular, the electromagnet 100 is used to control whether or not the retaining lever 200 is held in a position in contact with the electromagnet.

If a movable hook 13 has been held by the retaining lever 200, when the corresponding knifel4 again reaches the vicinity of the top dead center position of its trajectory, the knife 14 again pushes the body 502 and the blade 504 of the movable hook upwards, the blade again comes to bear against the guide ramp 218 to hold the retaining lever in contact with the lower pole face S124 of the electromagnet 100, as part of leveling. As before, the movable hook 13 may or may not be held in contact with the electromagnet, depending on the activation of the electromagnet 100.

Alternatively, the movable hook ensures the movement of the retaining lever from its remote position to its contact position, without holding the retaining lever in contact with the electromagnet, with the remaining travel of the retaining lever to its contact position being caused by energization of the electromagnet ("calling").

In the first embodiment, a single abutment surface S204 is used that is as far away as possible, from the oscillation axis A144 of the retaining lever 200 thereby reducing the length of the metal armature 202 to the minimum length necessary to establish the magnetic circuit between the first and second pole faces. In particular, the metal armature may extend only to the junction between the abutment surface S204 and the outer attracting surface S208, which is marked by the line L1. This reduces the length of the armature 202, thus reducing the inertia of the retaining lever 200 and its cost price.

Figure 16:
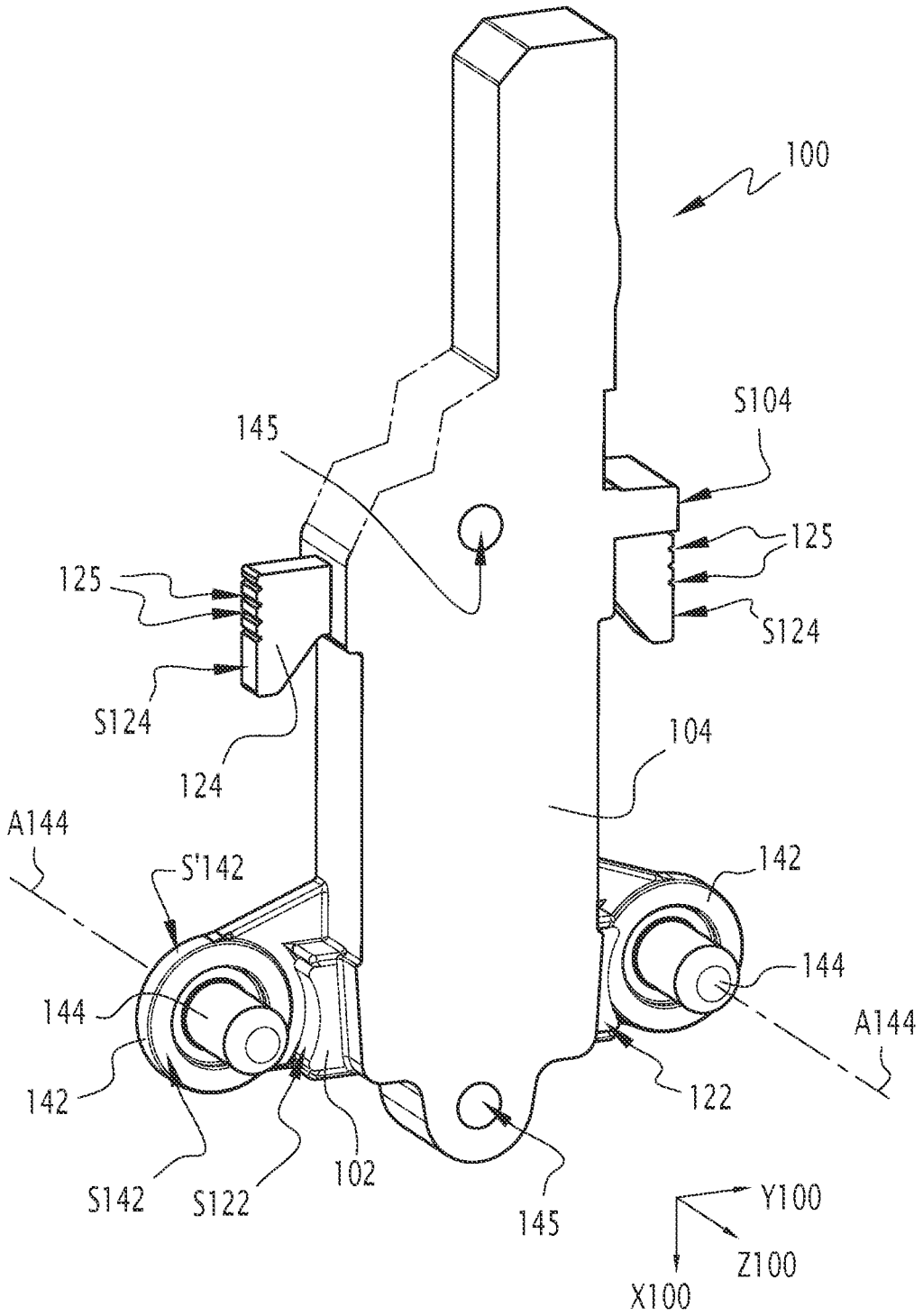
FIG. 16 is a partial view, comparable to FIG. 5, of an electromagnet belonging to a shedding mechanism consistent with a second embodiment of the invention.

In the second to fourth embodiments shown in FIG. 16 et seq. the elements similar to those in the first embodiment have the same references and operate in the same manner. In the following, what distinguishes these embodiments from the first embodiment is primarily described. Where a reference is used for a part of the second to fourth embodiments without being visible in the corresponding figure(s), that reference should be understood to refer to a part of the same reference in the first embodiment.

Figure 17:
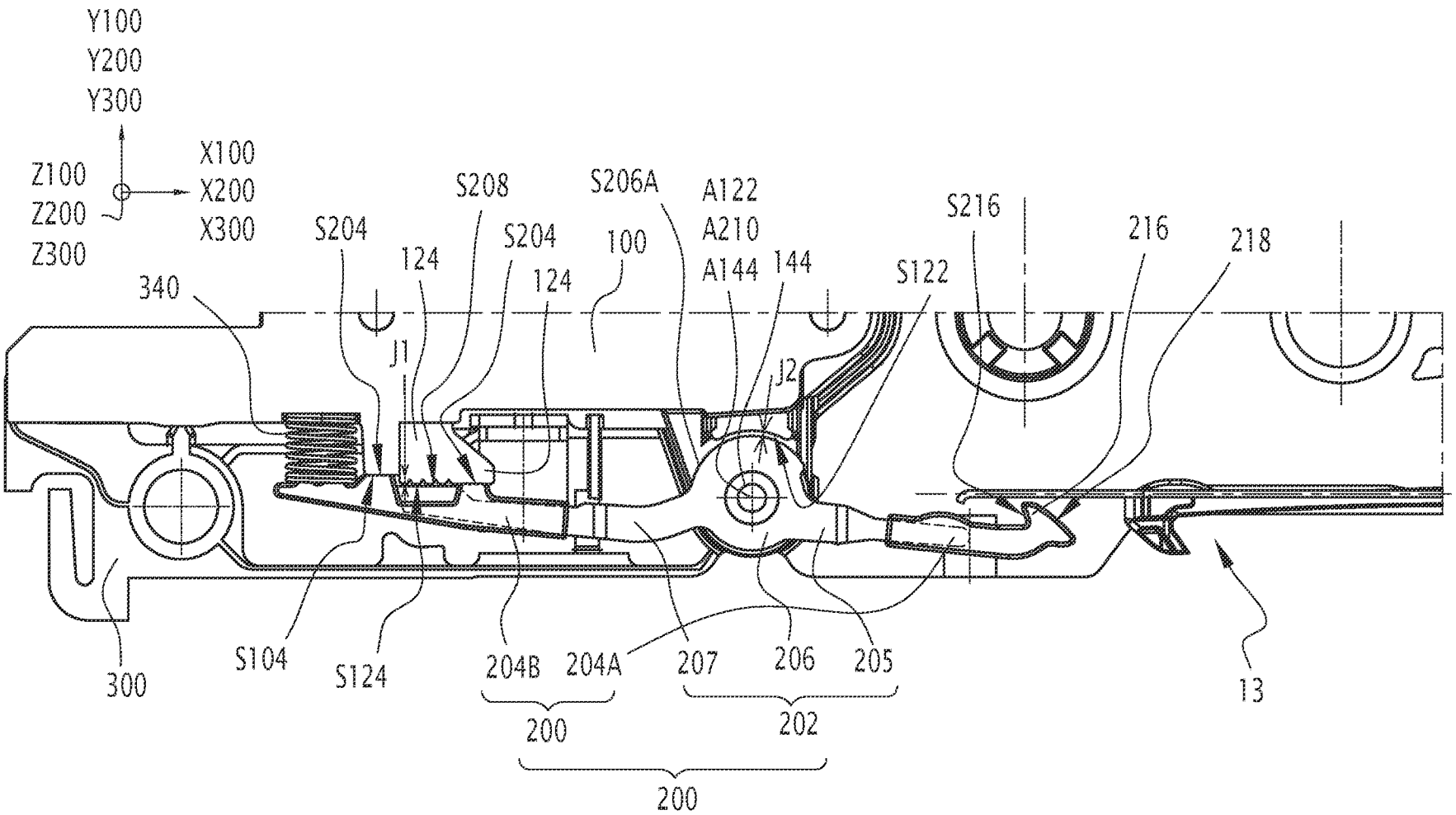
FIG. 17 is a partial view corresponding to the lower left portion of FIG. 11, for the shedding mechanism consistent with a second embodiment of the invention.

In the second embodiment shown in FIGS. 16 and 17, the first pole faces S122 formed by the ferromagnetic core 102 of the electromagnet 100 are located at the lower transverse branches 122 of the core 102 located at the lower portion of the electromagnet 100, while the second pole faces S124 are located at the upper transverse branches 124 of the core 102 located at the intermediate portion of this electromagnet 100. In the operating configuration of the shedding mechanism to which this electromagnet 100 belongs, the second pole faces S124 are arranged above the first pole faces S122, according to a longitudinal direction of this electromagnet 100 that is parallel to the axis X100. The frame 104 of the electromagnet 100 is pierced with two positioning recesses 145 intended to receive positioning members provided in the body 300 of the shedding mechanism. The second pole faces S124 are notched and provided with transverse grooves 125, which extend parallel to the axis Z100 and delimit separate strips of material between them, in a manner comparable to the grooves 224 and strips formed on the surface S204 of the first embodiment.

Here, two abutment surfaces S204 are delimited on the retaining lever 200 on either side, according to a longitudinal direction parallel to the axis X200, of the outer attracting surface S208 defined by the armature 202 of this lever.

Furthermore, the portion 206 of the armature 200, an opening 210 of which is engaged around the guide shaft 144, is defined in an intermediate area of the lever 200. In other words, the armature 202 comprises, in addition to this portion 206, two branches 205 and 207 which extend in opposite longitudinal directions, generally parallel to the axis X200, from this portion 206 and which respectively carry a first portion 204A and a second portion 204B of the non-magnetic body 204 of this retaining lever 200.

The first portion 204A defines the selection nose 216 and the guide ramp 218. The second portion 204B defines the two abutment surfaces S204. As in the previous embodiments, a spring 340 tends, by default, to move the abutment surfaces S204 away from the electromagnet 100.

As seen in FIG. 17, when the retaining lever 200 is in contact with the electromagnet 100, one of these abutment surfaces S204, namely the abutment surface closest to the oscillation axis A144, is in abutment against the second pole face S124, while the second abutment surface S204, the furthest away from the oscillation axis A144, is in abutment against a surface S104 defined by the frame 104. This surface S104 is shown only on the right-hand side of FIG. 18, where a portion of the electromagnet 100 has been omitted, for simplification.

In this second embodiment, since the portions 204A and 204B of the non-magnetic body 204 are not integral, it is possible to consider dispensing with the portion 204A. In this case, the selection nose and retaining ramp are formed directly on the armature 202 and may cooperate with a molded hook of synthetic material, as contemplated in EP-A-0823501.

Figure 18:
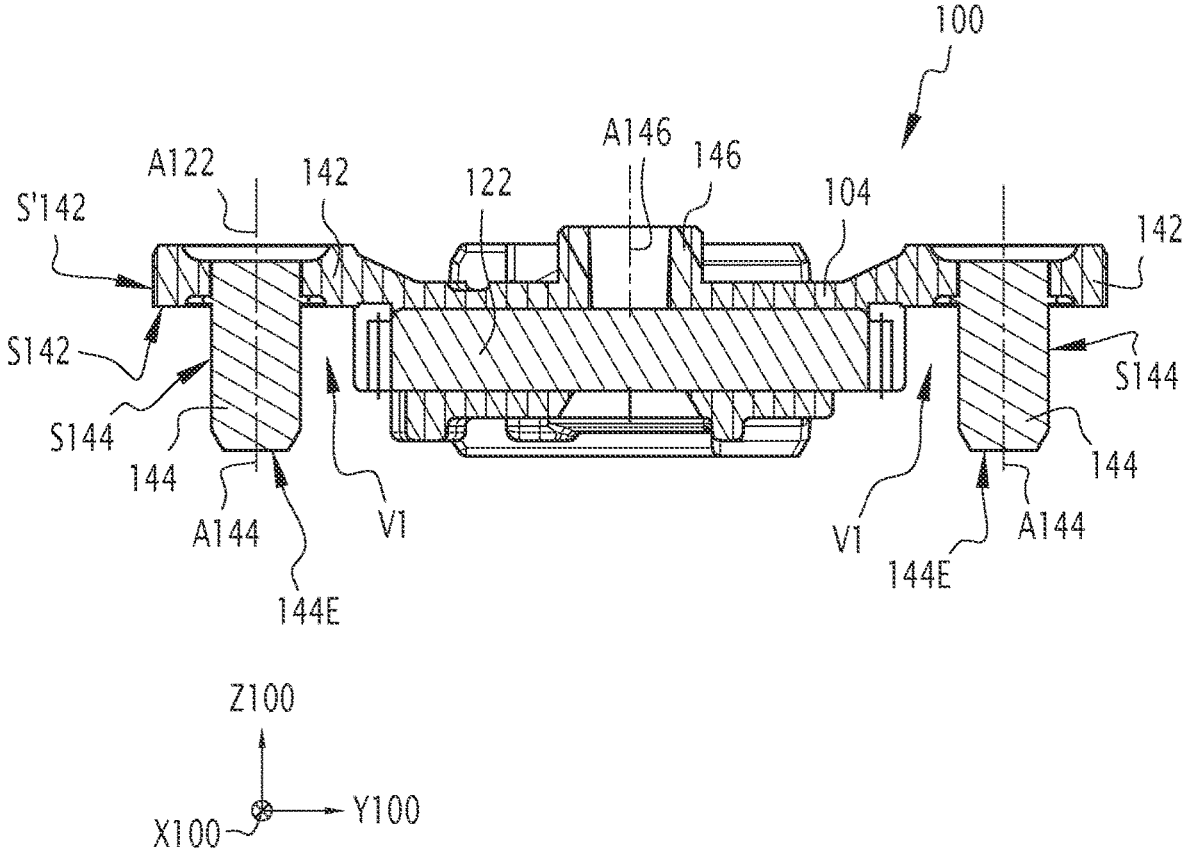
FIG. 18 is a cross-section, comparable to FIG. 4, of an electromagnet belonging to a shedding mechanism consistent with a third embodiment of the invention.

In the third embodiment shown in FIG. 18, the guide shafts 144 are formed on the non-magnetic portion of the electromagnet 100 integral with the ferromagnetic core 102 but are not integral with the non-magnetic frame 104 of the electromagnet 100. Thus, it is possible to use a different material to form these guide shafts 144 than the material of the frame 104 that includes the flanges 142. In particular, the guide shafts 144 are attached to the non-magnetic frame 104 of the electromagnet 100 and are inseparably connected to the non-magnetic frame 104 and to the flanges 142. The non-magnetic frame 104 then connects the shafts 144 and the core 102. The material of the guide shafts 144 may be a metal or a synthetic material that is non-magnetic and whose mechanical characteristics are particularly suited to its function, such as, for example, a ceramic material or a polymer other than that of the non-magnetic frame 104. Preferably, these guide shaft inserts are connected to the frame 104 during the overmolding operation on the core 102.

Figure 19:
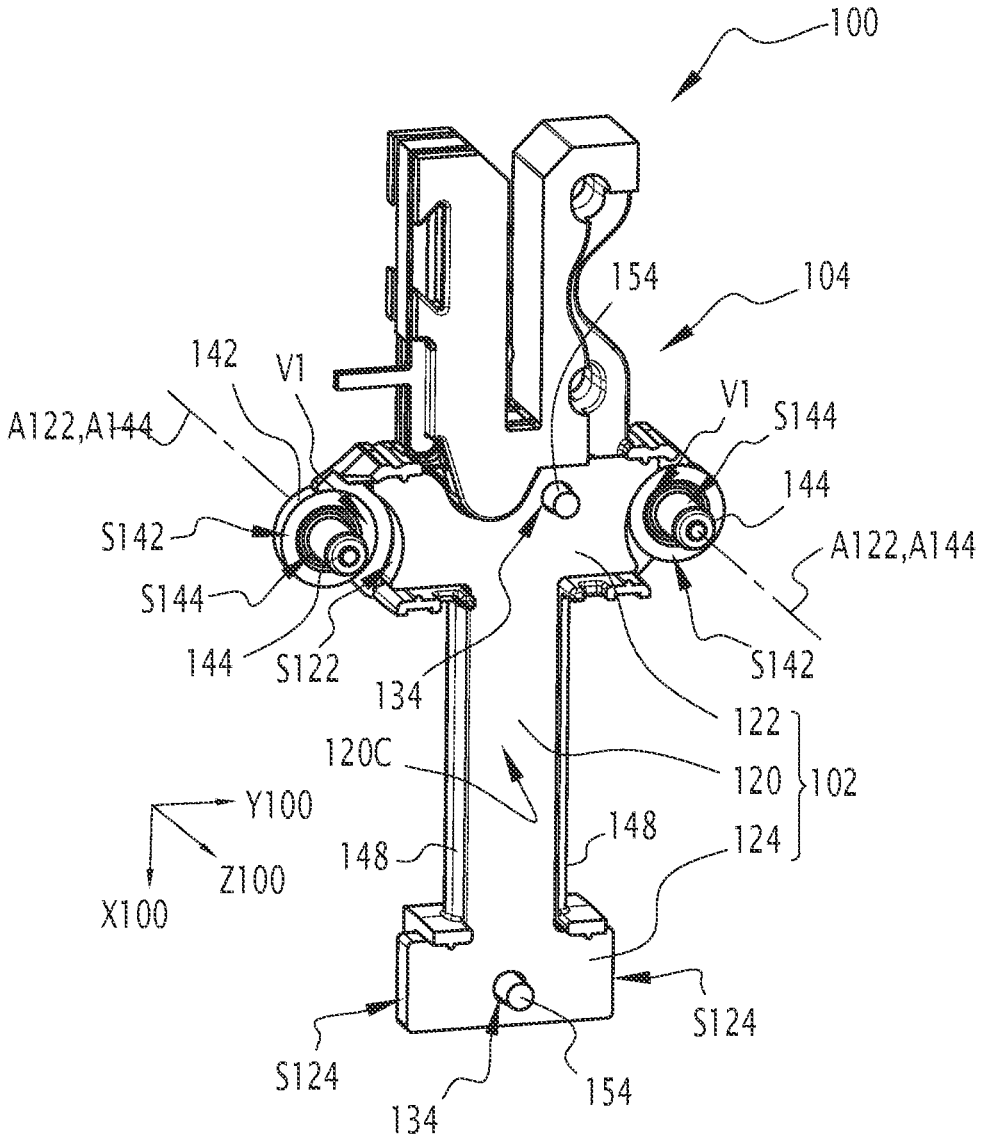
FIG. 19 is a perspective view, comparable to FIG. 3, for an electromagnet belonging to a shedding mechanism consistent with a fourth embodiment of the invention.
Figure 20:
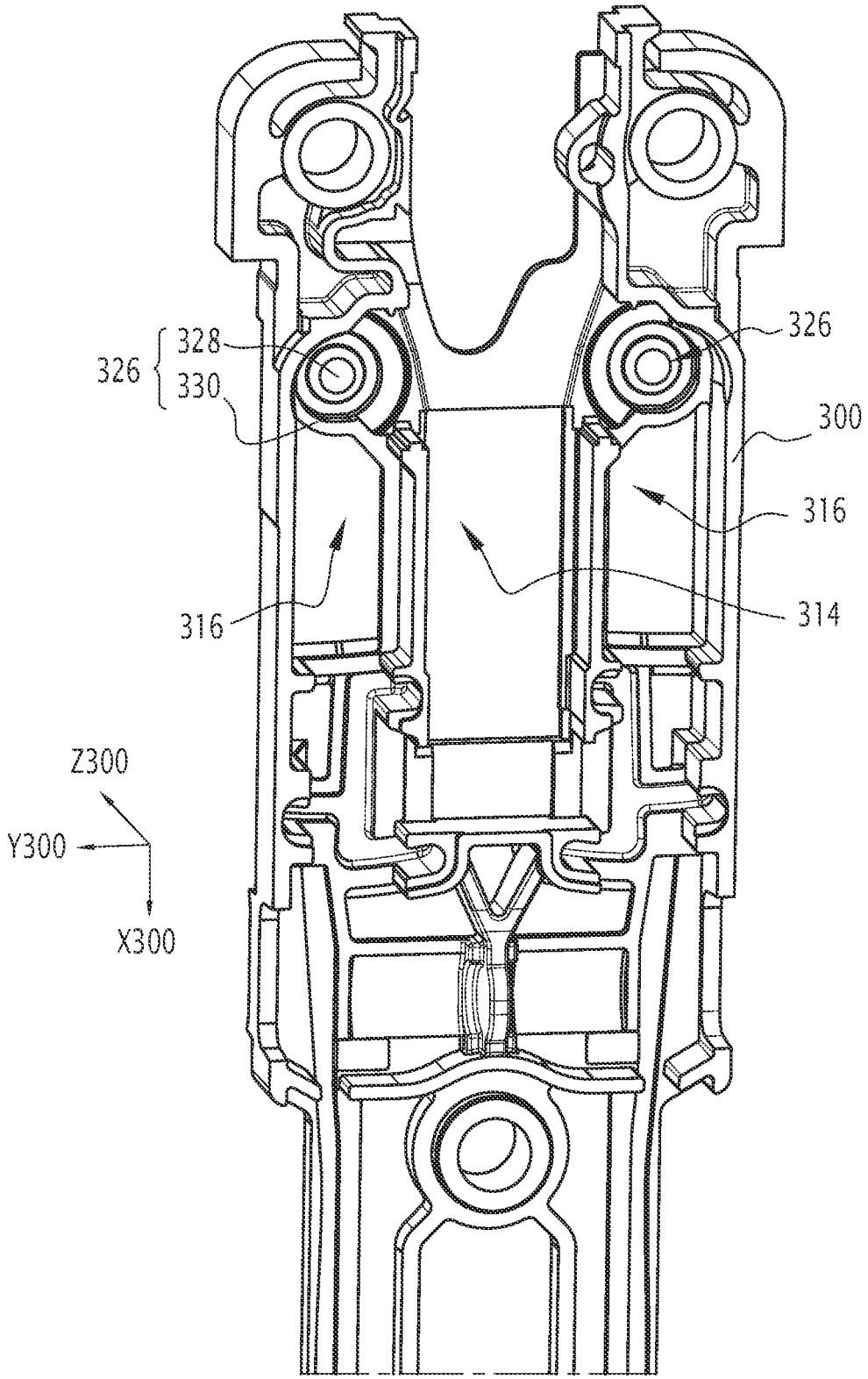
FIG. 20 is a partial perspective view of a housing of the shedding mechanism consistent with a fourth embodiment of the invention.

In the fourth embodiment of the invention shown in FIG. 19 et seq., the non-magnetic frame 104 is injection molded of a polymeric material and formed prior to its assembly with the ferromagnetic core 102. In practice, the non-magnetic frame 104 defines a volume for receiving the ferromagnetic core 102, the ferromagnetic core being centered in this receiving volume by means of two pins 154 which are part of the frame 104 and which pass through two correspondingly shaped holes 134 provided in the ferromagnetic core 102.

As in the first embodiment, the injected frame is one-piece and comprises two guide shafts 144 and two flanges 142 which define, by their respective surfaces S144 and S142 and with the first pole faces S122, the volumes V1 for partial reception of the armatures of two retaining levers which may be identical to those of the first embodiment. The two guide surfaces S144 are thus formed on parts 144 of the electromagnet that are integral with each other.

The unitary housing 300 of this fourth embodiment defines, as in the first embodiment, a recess 314, in which the portion of the electromagnet 100 that carries the winding can be engaged, and two retaining lever receiving areas 316. Two housings 326 for receiving the flanges 142 and the guide shafts 144 are provided on either side of the recess 314, according to a transverse direction of the unitary housing 300, which is parallel to an axis Y300 defined as in the first embodiment, within an orthogonal reference frame X300, Y300, Z300. For the remainder, this housing is comparable to that of the first embodiment, except that its geometry is adapted to that of the electromagnet 100 partially shown in FIG. 19. In particular, each housing 326 is defined by a planar surface 328 and by a rib 330 that surrounds a flange 142 of the electromagnet 100, in the mounted configuration of the electromagnet in the housing 300.

Figure 21:
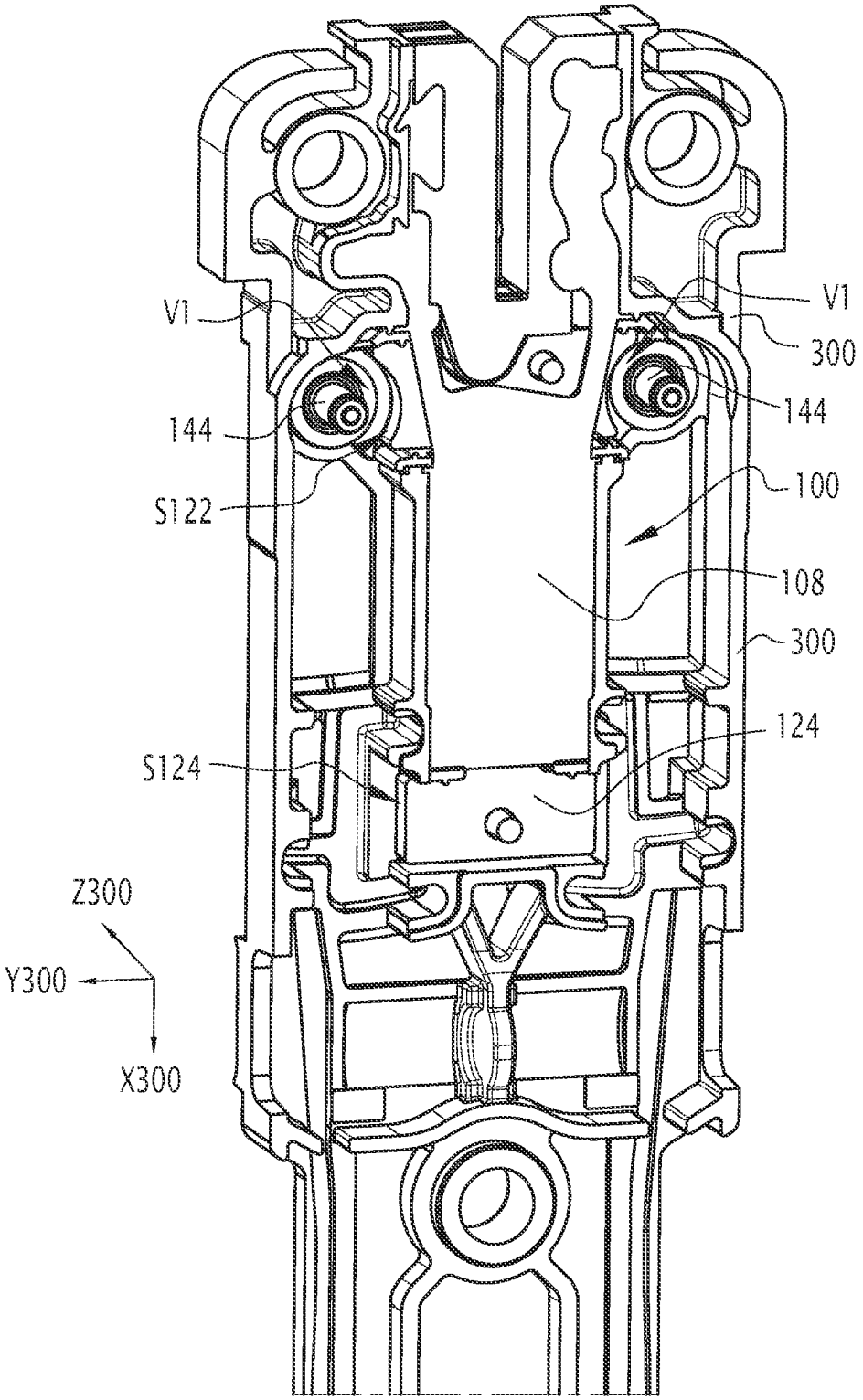
FIG. 21 is a perspective view of the housing of FIG. 20 equipped with the electromagnet the frame of which is shown in FIG. 19.

When the electromagnet 100 has been wound, starting from the configuration shown in FIG. 19, with the winding wrapping around the intermediate portion 120, in contact with the lateral faces 120C and 120D and around the strips 148, defined as in the first embodiment, it is placed in the housing 300, then a quantity of polymer material forming a covering 108 is introduced into the housing by overmolding and partially covers the electromagnet in order to protect the winding and to immobilize, in an undetachable manner, the electromagnet 100 in the housing 300. During its overmolding in the housing 300, the covering 108 is contained so as to remain at a distance from the pole faces S122 and S124. This makes it possible to reach the configuration of FIG. 21 from which the retaining levers can be positioned in the housing 300, by engaging holes provided in their respective armatures around the guide shafts 144, as envisaged for the first embodiment.

In an alternative embodiment not shown, the winding wraps around the longitudinal branch and central stem 120, contacting only one of the lateral faces 120C or 120D and around the strips 148, with the frame extending opposite, according to the axis Z100, the other of the lateral faces 120C or 120D, between the two strips 148.

In the embodiments of FIGS. 16 to 21, in the contact configuration of the retaining lever 200 in contact with the electromagnet 100 and as in the first embodiment, there is an air gap of non-zero width between the surfaces S208 and S124 or equivalent.

Regardless of the embodiment, the fact that the oscillation axis of the retaining lever is arranged at the longitudinal level of the first pole face guarantees good control of the air gap between the armature of the movable retaining lever and this first pole face with a radial width equal to the non-zero gap J2, taken radially to the axes A122, A144, whatever the position of the retaining lever between its remote position and its position in contact with the electromagnet. Alternatively, the gap J2 may be variable over the angular extent of the air gap between the armature and the first pole face. On the other hand, the abutment surface guarantees a good control of the air gap of width equal to the gap J1, measured parallel to the axes Y100, Y200 and Y300, between the retaining lever and the second pole face, when the retaining lever is in its position in contact with the electromagnet. Because the abutment surface is located on the retaining lever, rather than on the electromagnet, its position relative to the guide ramp and the selection nose is defined with great precision, notably a better precision than if this surface were provided on the electromagnet. In addition, providing the abutment surface on the retaining lever simplifies the construction of the electromagnet, which is a more cumbersome and complicated part to manufacture than the retaining lever itself.

Regardless of the embodiment, forming the flanges 142 integrally with the non-magnetic housing 104 of the electromagnet 100 maximizes the positioning precision between the retaining lever 200 and the ferromagnetic core 102 in a direction parallel to the axes Z100, Z200, and Z300. This allows for good control of the air gaps between the retaining levers 200 and the electromagnet 100.

Regardless of the embodiment, defining the guide surface S144 on the electromagnet 100 allows the electromagnet to be tested for proper operation, by means of a test hold-down lever, prior to installing the electromagnet in the unitary housing 300.

By arranging the first pole face S122 of the electromagnet 100 in the vicinity of the oscillation axis A144, the control of the air gap between each retaining lever 200 and the ferromagnetic core 102 makes it possible to decrease the angular amplitude of the portion of cylinder forming the first pole face 122 by distributing this portion of cylinder relative to the transverse plane P144, as explained above with the angles $\alpha$, $\alpha 1$ and $\alpha 2$. Indeed, as the geometric precision of the air gap achieved at this level is improved over the prior art, the angular amplitude of the air gap in a portion of the cylinder and the outer diameter of the guide shaft 144 can be reduced.

In the first three embodiments of the invention, where the electromagnet 100 provided with its cover 108 is fitted into the unitary housing 300, no overmolding operation in the housing is required, which simplifies the manufacture of this part of the shedding mechanism 7, allowing the use of wider tolerances, which is all the more advantageous since the housing 300 is a relatively thin and elongated part.

In the first three embodiments of the invention, mounting the electromagnet 100 to the unitary housing 300 by form-fit cooperation, with minimal or no clearance, is easy to implement and compatible with disassembly of the shedding mechanism. Thus, if a guide shaft 144 wears out, the electromagnet 100 to which it belongs can be easily replaced without having to change the unitary housing 300 or the other members contained therein.

Regardless of the embodiment, the presence of the recess 314 and the fact that the winding 106 is in direct contact with the lateral faces 120C and 120D of the central stem 120 of the ferromagnetic core 102 provides a good compact form for each unitary housing 300 equipped with an electromagnet 100, according to a direction parallel to the axis Z300.

In the various embodiments, the offset of the deflectors on each lateral side of the unitary housing induces that they form, on each transverse side of the retaining lever, a relatively long edge, which improves the sealing obtained.

In all embodiments, in the mounted configuration of the selection device 400 in the shedding mechanism 7, the first pole faces S122 are offset relative to the second pole faces S124, according to the longitudinal direction of the shedding mechanism which is parallel to the axes X100 and X300 which are then coincident. The winding extends between the first pole faces S122 and the second pole faces S124 in the longitudinal direction.

According to an unshown variant of the invention, the guide surface formed on the electromagnet 100 and which interacts with the retaining lever 200 is a surface arranged outside of this retaining lever 200, i.e., a surface which partially surrounds it. Such a guide surface may be a concave surface in the form of a portion of a cylinder that faces a cylindrical outer radial surface of the lever 200, centered on the oscillation axis, for example on the side opposite the core of the electromagnet 100. This is a mirror configuration of those shown in the figures. As with all embodiments, the guide surface is separate from any pole face of the electromagnet and is preferably located on the frame 104. When the oscillation axis of the lever is at the level of the first pole face, the radial gap between the guide surface and the cylindrical outer radial surface of the lever, is strictly less than the dimension of the air gap between the first pole face and the facing surface of the lever.

According to another unshown variant of the invention, the electromagnet 100 may be mounted in the unitary housing 300 such that its guide shafts 144 extend, from the flanges 142, towards the bottom 303 of the half-shell 302 that houses the electromagnet 100. The longitudinal ends 206 of the retaining levers 200 are then received between the flanges 142 and the bottom 302 of the half-shell 302 that houses the electromagnet 100. The free end 144E of the shaft of each guide shaft 144 then cooperates with a recessed housing, comparable to the recessed housing 344 of the first embodiment, which is provided not on a second adjacent housing but in the bottom 303 of the housing 300 in which the electromagnet 100 is received.

According to another unshown variant of the invention, a centering pin comparable to the centering pin 146 is provided in the unitary housing 300, while a correspondingly shaped recess comparable to the recess 320 is provided on the electromagnet, preferably in its non-magnetic frame 104. This facilitates the placement of the electromagnet 100 in the housing 300, similar to the cooperation of the elements 146 and 320 in the first embodiment.

According to another unshown variant of the invention, the oscillation axes A144 may extend in a direction parallel to the axis Y100, and not in a direction parallel to the axis Z100. The flange 142 then preferably extends in a plane parallel to the plane formed by the axes X100 and Z100.

According to an unshown variant of the invention, in the context of two-position mechanism associations, a housing may receive two electromagnets each defining two guide shafts, these two electromagnets being superimposed in the longitudinal direction as described, for example, in EP-B-1619279, to allow three or four positions of the heald to be reached, which allows fabrics other than so-called "flat" fabrics to be woven. The selection device then comprises more than two movable hooks, these movable hooks being integral, in pairs, with a single cord.

According to another not shown variant of the invention, a single movable hook 13 or more than two movable hooks may be provided in the housing 30.

The embodiments and variants contemplated above may be combined to generate new embodiments of the invention.

The invention claimed is:

1. A shedding mechanism on a Jacquard-type weaving loom, this mechanism comprising a housing extending according to a longitudinal direction, at least one movable hook, moved in the housing by a knife according to a longitudinal direction between a bottom dead center position and a top dead center position, in or near which the hook can be retained by a selection device which comprises at least an electromagnet which is mounted and fixed in the housing, and which includes a ferromagnetic core comprising a first pole face and a second pole face, these pole faces being offset from each other according to the longitudinal direction, and a non-magnetic portion integral with the ferromagnetic core a retaining lever configured to retain the movable hook when this is in or near its top dead center position, the retaining lever being pivotally mounted about an oscillation axis between a position remote from the electromagnet and a position in contact with the electromagnet, and comprising a ferromagnetic armature that magnetically interacts with the first and second pole faces to control the angular position of the retaining lever about the oscillation axis wherein the non-magnetic portion of the electromagnet comprises a guide surface for the pivotal movement of the retaining lever about the oscillation axis, this guide surface cooperating with the retaining lever in a direction radial to the oscillation axis between the remote position and the contact position, and the guide surface is cylindrical with a circular base, centered on the oscillation axis.

2. The mechanism according to claim 1, wherein the guide surface is the outer peripheral surface of a guide shaft around which the retaining lever is pivotally mounted.

3. The mechanism according to claim 1, wherein the non-magnetic portion of the electromagnet also comprises a flange from which the guide surface extends and wherein a volume for receiving a portion of the retaining lever is delimited, according to a direction radial to the oscillation axis, by the guide surface and, according to a direction parallel to the oscillation axis, by the flange.

4. The mechanism according to claim 3, wherein the guide surface is the outer peripheral surface of a guide shaft around which the retaining lever is pivotally mounted wherein the flange is arranged in a ring around one end of the guide shaft.

5. The mechanism according to claim 3, wherein the guide surface is the outer peripheral surface of a guide shaft around which the retaining lever is pivotally mounted, wherein the housing is formed of a half-shell for receiving the selection device and of a cover, the half-shell and the cover being stacked in a second direction of the housing which is perpendicular to the longitudinal direction, wherein the oscillation axis extends in the second direction of the housing, wherein the half-shell or the cover forms a recessed housing complementary in shape to the guide shaft and an annular surface formed around the hollow housing, wherein a free end of the guide shaft, opposite the flange is engaged in the hollow housing and presses against a bottom of this hollow housing, according to the second direction of the housing, and wherein a portion of the retaining lever is arranged between the flange and the annular surface according to the second direction of the housing.

6. The mechanism according to claim 1, wherein the first pole face of the ferromagnetic core is a portion of a cylinder centered on the oscillation axis, wherein part of the armature of the retaining lever is interposed between the guide surface and the first pole face radially to the oscillation axis and wherein the cooperation between the guide surface and the retaining lever ensures that there is no contact between the first pole face and the armature between the contact position and the remote position of the retaining lever.

7. The mechanism according to claim 6, wherein the first pole face extends on either side of a transverse plane passing through the oscillation axis and perpendicular to the longitudinal direction and wherein the ratio between, on the one hand, the angular amplitude of a portion of the first pole face located, relative to the transverse plane, on the same side as the second pole face and, on the other hand, the total angular amplitude of the first pole face, is between 0.2 and 0.4.

8. The mechanism according to claim 7, wherein the ratio between, on the one hand, the angular amplitude of the portion of the first pole face located, relative to the transverse plane, on the same side as the second pole face and, on the other hand, the total angular amplitude of the first pole face is equal to 0.33.

9. The mechanism according to claim 1, wherein the armature of the retaining lever comprises an outer attracting surface which is opposite the second pole face when the retaining lever is in a position in which it is in contact with the electromagnet, wherein the retaining lever comprises a non-magnetic body which is integral with the armature and which comprises at least one abutment surface which is adjacent to the outer attracting surface protruding, in the direction of the electromagnet, relative to the outer attracting surface remote from the electromagnet when the retaining lever is in its position remote from the electromagnet; and in contact with the electromagnet when the retaining lever is in its position in contact with the electromagnet, and wherein, when the retaining lever is in its position in contact with the electromagnet, the outer attracting surface is remote from the second pole face.

10. The mechanism according to claim 1, wherein the non-magnetic part of the electromagnet comprises a frame which comprises the guide surface and which is made of polymeric material overmolded on the ferromagnetic core.

11. The mechanism according to claim 1, wherein the electromagnet is fixed in the housing by cooperation of forms, with fitting of a centering pin in a centering housing, according to a direction of the housing perpendicular to its longitudinal direction.

12. The mechanism according to claim 1, wherein the non-magnetic part of the electromagnet comprises a frame which comprises the guide surface, the frame being formed prior to its assembly with the ferromagnetic core, and wherein a quantity of polymeric material extends around the core and the frame to hold the electromagnet in the housing.

13. The mechanism according to claim 1, wherein the selection device comprises at least two retaining levers which are arranged at the same longitudinal level in the housing, on each side of the electromagnet according to a direction perpendicular to the longitudinal direction and which each interacts with one of two lower pole faces and one of two upper pole faces of the ferromagnetic core, and wherein the guide surfaces which each cooperate with a retaining lever are formed on portions of the electromagnet which are integral with each other.

14. The mechanism according to claim 1, wherein a winding of the electromagnet is wound around an intermediate portion of the ferromagnetic core, arranged longitudinally between the first and second pole faces, and is in contact with at least one lateral face of the ferromagnetic core.

15. The mechanism according to claim 1, wherein a surface of a first longitudinal end of the retaining lever cooperates with the guide surface for pivoting the lever between the remote position and the contact position, and wherein, in the operating configuration of the mechanism, the retaining lever extends generally from the first longitudinal end downwards according to the longitudinal direction.

16. A Jacquard-type weaving loom, wherein it comprises a shedding mechanism according to claim 1.

* * * * *